US008261469B2

(12) United States Patent
Aveni et al.

(10) Patent No.: US 8,261,469 B2
(45) Date of Patent: Sep. 11, 2012

(54) ARTICLES OF FOOTWEAR AND OTHER FOOT-RECEIVING DEVICES INCLUDING DIFFERENTLY ORIENTED IMPACT-ATTENUATION ELEMENTS

(75) Inventors: Michael A. Aveni, Lake Oswego, OR (US); Patricia L. Smaldone, Portland, OR (US); Fred G. Fagergren, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 1122 days.

(21) Appl. No.: 11/459,093

(22) Filed: Jul. 21, 2006

(65) Prior Publication Data

US 2008/0016719 A1 Jan. 24, 2008

(51) Int. Cl.
*A43B 13/18* (2006.01)
*A43B 13/28* (2006.01)
*A43B 23/00* (2006.01)

(52) U.S. Cl. ..... 36/28; 36/103; 36/114; 36/35 R

(58) Field of Classification Search ..... 36/27, 28, 36/25 R, 30 R, 31, 35 R, 59 R, 15, 100, 103
See application file for complete search history.

(56) References Cited

U.S. PATENT DOCUMENTS

| | | | | |
|---|---|---|---|---|
| 5,916,071 | A * | 6/1999 | Lee | 482/77 |
| 5,983,529 | A * | 11/1999 | Serna | 36/28 |
| 6,023,859 | A * | 2/2000 | Burke et al. | 36/105 |
| 6,282,814 | B1 * | 9/2001 | Krafsur et al. | 36/27 |
| 6,722,058 | B2 * | 4/2004 | Lucas et al. | 36/28 |
| 6,807,753 | B2 * | 10/2004 | Steszyn et al. | 36/28 |
| 7,013,582 | B2 * | 3/2006 | Lucas et al. | 36/28 |
| 7,314,125 | B2 * | 1/2008 | Smaldone et al. | 188/372 |
| 7,458,172 | B2 * | 12/2008 | Aveni | 36/27 |
| 2002/0038522 | A1 | 4/2002 | Houser et al. | |
| 2006/0064900 | A1 | 3/2006 | Aveni | |
| 2006/0065499 | A1 | 3/2006 | Smaldone et al. | |
| 2006/0130365 | A1 | 6/2006 | Sokolowski | |
| 2006/0185191 | A1 | 8/2006 | Crowley | |

FOREIGN PATENT DOCUMENTS

EP 1530913 A1 5/2005

(Continued)

OTHER PUBLICATIONS

International Search Report dated Mar. 4, 2008 of Application No. PCT/US2007/016098.

Internet printout: http://www.shopadidas.com/product/index—Men's Footware: Running: a3 Gigaride dated May 15, 2006.

(Continued)

*Primary Examiner* — Jila M Mohandesi

(74) *Attorney, Agent, or Firm* — Banner & Witcoff, Ltd.

(57) ABSTRACT

Impact-attenuation systems, e.g., for use in footwear, can help control foot positioning during a step cycle, e.g., to help reduce or eliminate misorientation of the foot, and the fatigue and/or strain that may result from such misorientation. Articles of footwear including such impact-attenuation systems may include: (a) an upper member; and (b) a sole structure engaged with the upper member. The sole structure may include: (i) a first impact-attenuating member located in a heel portion of the foot-supporting member, and (ii) a second, separate impact-attenuating member located at a rear, lateral heel portion. The second impact-attenuating member may be arranged at a different orientation with respect to the longitudinal direction as compared to the first orientation. Impact-attenuation systems having the characteristics described above, as well as methods of making and using products containing such systems, also are described.

58 Claims, 16 Drawing Sheets

FOREIGN PATENT DOCUMENTS

| | | | |
|---|---|---|---|
| WO | 2006 016254 | | 2/2006 |
| WO | 2006 016254 | A2 | 2/2006 |
| WO | 2006038338 | A1 | 4/2006 |
| WO | 2007 145809 | A2 | 12/2007 |
| WO | 2007 145810 | A1 | 12/2007 |

OTHER PUBLICATIONS

Co-pending U.S. Appl. No. 11/422,137, filed Jun. 5, 2006.
Co-pending U.S. Appl. No. 11/422,138, filed Jun. 5, 2006.
Office Action in European Patent Application No. 07796877.4 mailed Jul. 26, 2011.

* cited by examiner

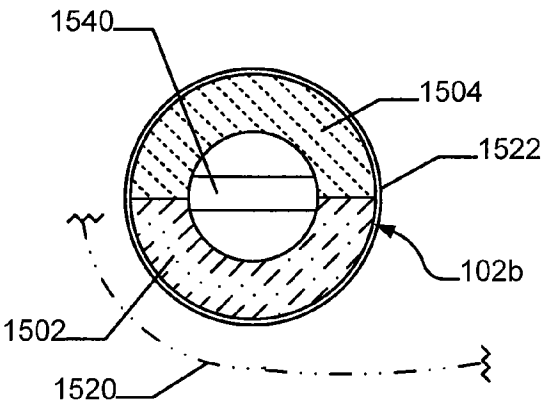
FIG. 15B
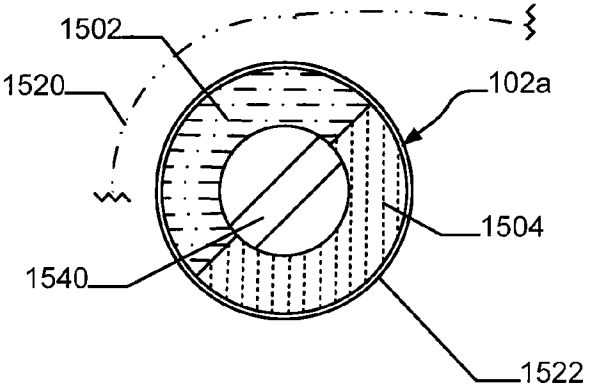
FIG. 15C
FIG. 16A
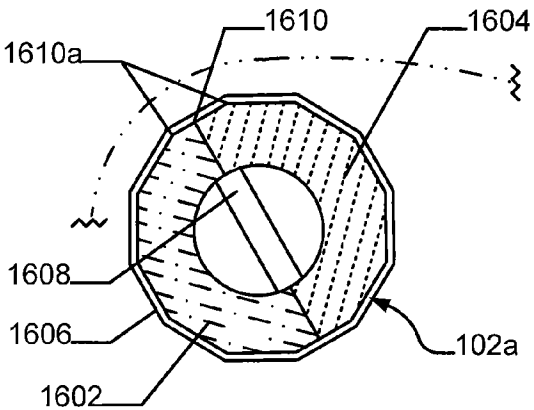
FIG. 16B

ARTICLES OF FOOTWEAR AND OTHER FOOT-RECEIVING DEVICES INCLUDING DIFFERENTLY ORIENTED IMPACT-ATTENUATION ELEMENTS

RELATED APPLICATION DATA

This invention relates to and may be used in conjunction with the impact-attenuating members described, for example, in U.S. patent application Ser. No. 10/949,812 filed Sep. 27, 2004 in the name of Patricia Smaldone, et al. (now U.S. Published Patent Appln. No. 2006/065499 published Mar. 30, 2006); U.S. patent application Ser. No. 10/949,813 filed Sep. 27, 2004 in the name of Michael Aveni (now U.S. Published Patent Appln. No. 2006/064900 published Mar. 30, 2006); U.S. patent application Ser. No. 11/287,474 filed Nov. 28, 2005 in the name of Susan Sokolowski, et al.; U.S. patent application Ser. No. 11/422,137 filed Jun. 5, 2006 in the name of Michael A. Aveni, et al.; and U.S. patent application Ser. No. 11/422,138 filed Jun. 5, 2006 in the name of Michael A. Aveni, et al. These applications and publications are entirely incorporated herein by reference.

FIELD OF THE INVENTION

The invention relates generally to impact-attenuation systems, e.g., for use in footwear and other foot-receiving devices, such as in the heel areas of footwear or foot-receiving device products.

BACKGROUND

Conventional articles of athletic footwear have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground or other contact surface reaction forces, the sole structure may provide traction and control foot motions, such as pronation. Accordingly, the upper member and sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces.

SUMMARY

Aspects of this invention relate to impact-attenuation systems, e.g., for use in footwear and other foot-receiving devices, such as in the heel areas of footwear or foot-receiving device products. Such impact-attenuation systems may be used, at least in part, to help control foot positioning during a step cycle, e.g., to help reduce or eliminate misorientation of the foot, and the fatigue and/or strain that may result from such misorientation.

More specific aspects of this invention relate to foot-receiving device products, such as articles of footwear, that include: (a) a foot-covering member, such as an upper member for an article of footwear; and (b) a foot-supporting member (such as a sole structure) engaged with the foot-covering member. The foot-supporting member (e.g., sole structure) may include: (i) a first impact-attenuating member located in a heel portion of the foot-supporting member, wherein the first impact-attenuating member is arranged in a first orientation with respect to a longitudinal direction (e.g., heel-to-toe direction) of the foot-supporting member, and (ii) a second impact-attenuating member separate from the first impact-attenuating member, wherein the second impact-attenuating member is located at a rear, lateral heel portion of the foot-supporting member. The second impact-attenuating member, which may have the same general structure and/or construction as the first impact-attenuating member, may be arranged at a second, different orientation with respect to the longitudinal direction as compared to the first orientation (e.g., rotated as compared to the orientation of the first impact-attenuating member). Also, other impact-attenuating members, when present, may be arranged in the first orientation or in another orientation, if desired. In at least some example structures according to the invention, the step landing impact-attenuating element or column (e.g., the rearmost lateral heel column or element) will be constructed and/or arranged so as to be softer than the posting element or column.

Still additional aspects of this invention relate to foot-supporting members and/or impact-attenuating systems, e.g., sole structures or portions thereof, such as a heel unit or the like, that include two or more impact-attenuating members, e.g., of the various types, constructions, orientations, and/or relative characteristics described above. If desired, the various impact-attenuating members may be engaged with a common base member, e.g., to provide an impact-attenuating system or structure that is insertable as a unit into an article of footwear or other foot-receiving device constructions.

Other aspects of this invention relate to methods of making footwear or other foot-receiving device products including impact-attenuation members in accordance with examples of this invention, e.g., of the various types, constructions, orientations, and/or relative characteristics described above. Once incorporated in an article of footwear or other foot-receiving device product structure, the article of footwear or other product may be used in a known and conventional manner (e.g., for athletic or ambulatory activities) and the impact-attenuation members will attenuate the ground reaction forces (e.g., from landing a step or jump).

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein:

FIGS. 3 through 17B illustrate various examples of impact-attenuation elements that may be used in foot-receiving devices, such as articles of footwear, according to some examples of this invention.

DETAILED DESCRIPTION

Figure 1:
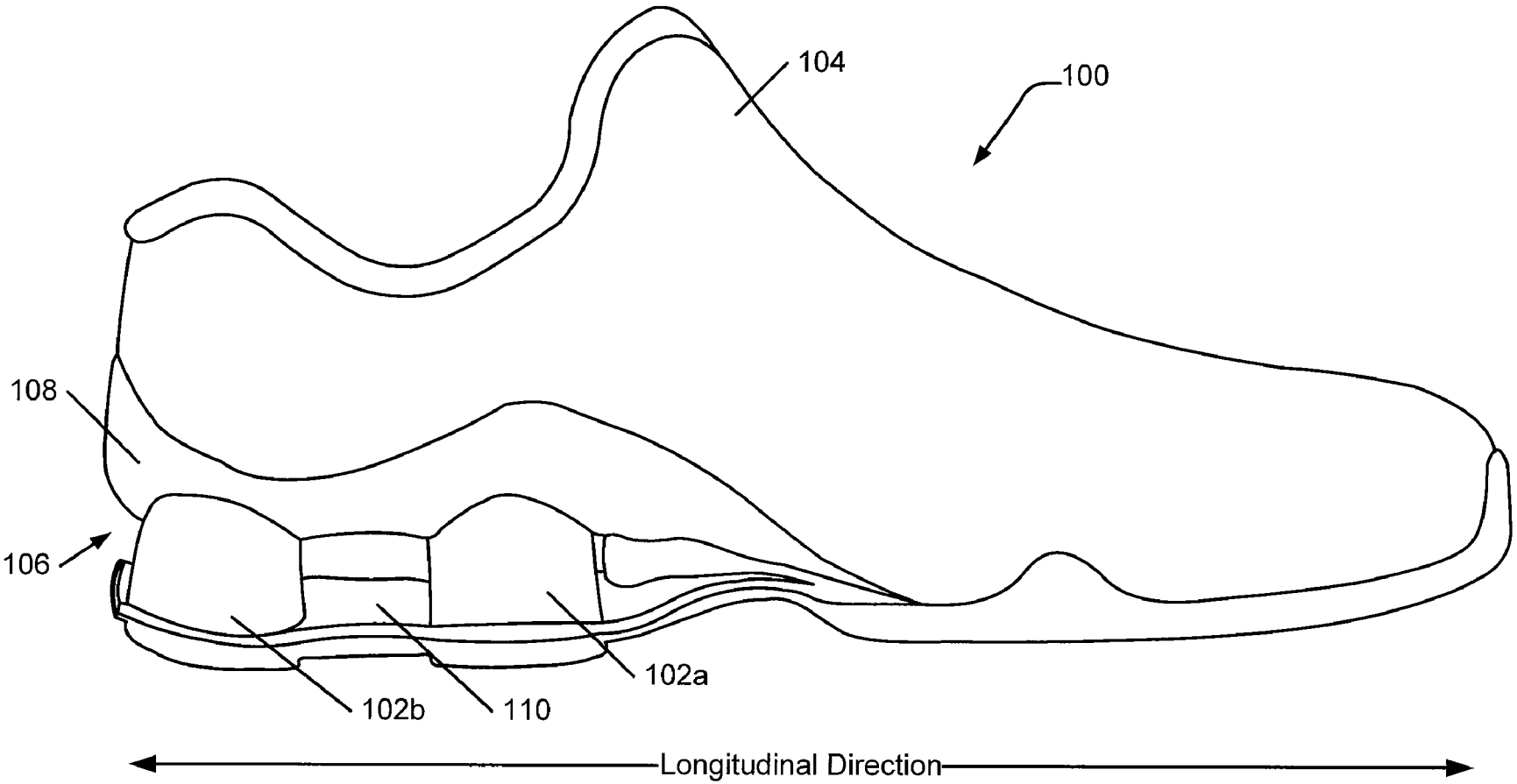
FIG. 1 generally illustrates an article of footwear (e.g., athletic footwear) in accordance with some examples of this invention.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "side," "front," "rear," "upper," "lower," "vertical," "horizontal," and the like may be used in this specification to describe various example features and elements of the invention, these terms are used herein as a matter of convenience, e.g., based on the example orientations shown in the figures, orientations at rest, and/or orientations during typical use. Nothing in this specification should be construed as requiring a specific three dimensional orientation of structures in order to fall within the scope of this invention.

To assist the reader, this specification is broken into various subsections, as follows: Terms; General Background Relating to the Invention; General Description of Impact-Attenuation Systems and Products Containing Them; Specific Examples of the Invention; and Conclusion.

A. TERMS

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, basketball shoes, tennis shoes, baseball cleats, soccer or football cleats, ski boots, etc.), and the like.

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. GENERAL BACKGROUND RELATING TO THE INVENTION

In producing athletic footwear, manufacturers generally tend to restrict movement of a wearer of the footwear as little as possible. However, due to the different loads that arise on bones and muscles during ambulatory activities, footwear also should be designed to reduce fatigue and/or the risk of injuries under the incident loads. One cause of premature fatigue of joints and/or muscles during exercise relates to the misorientation of the foot during a step cycle. During a step, the average person tends to first contact the ground with the heel and subsequently rolls-off off the heel using the ball of the foot.

Many people slightly turn their foot from the outside to the inside between the first ground contact with the heel and pushing-off with the ball of the foot. At ground contact, a person's center of mass typically is located more on the lateral side (the outside) of the foot, but it tends to shift to the medial side (the inside) during the course of the step cycle. This turning of the foot to the medial side is called "pronation." "Supination," on the other hand, constitutes a turning of the foot in the opposite direction during the course of a step. Supination and excessive pronation can lead to increased strain on the joints and premature fatigue or even injury. Therefore, manufacturers of shoes, and particularly athletic shoes, make efforts to control the degree of turning of the foot during a step cycle in order to avoid these misorientations.

There are a number of known ways of influencing pronation. For example, supporting elements often are placed in the midfoot and/or forefoot areas of a sole structure to help users avoid excessive turning of the foot to the medial and/or lateral sides, e.g., during push-off. Typically, the heel portion of such sole structures only serves to attenuate ground reaction forces. Such corrective measures, however, fail to recognize that the initial ground contact phase of a step cycle also influences the later course of motion of the foot during the step.

At least some aspects of the present invention relate to providing foot-supporting structures for articles of footwear and other foot-receiving device products that help provide improved and/or correct orientation of a foot starting from the first ground contact phase of a step cycle. Such improvements and/or corrections can help reduce and/or eliminate misorienations, premature fatigue, and/or wear of the joints and the muscles.

C. GENERAL DESCRIPTION OF IMPACT-ATTENUATION SYSTEMS AND PRODUCTS CONTAINING THEM

In general, aspects of this invention relate to impact-attenuation members, products and systems in which they are used (such as footwear, other foot-receiving devices, heel cage elements, and the like), and methods for including them in such products and systems and using them in such products and systems. These and other aspects and features of the invention are described in more detail below.

1. Foot-Receiving Device Products Including Impact-Attenuation Members According to the Invention Foot-receiving device products, such as articles of footwear, in accordance with at least some example aspects of this invention, include: (a) a foot-covering member, such as an upper member for an article of footwear; and (b) a foot-supporting member (such as a sole structure) engaged with the foot-covering member. The foot-supporting member (e.g., sole structure) may include: (i) a first impact-attenuating member located in a heel portion of the foot-supporting member, wherein the first impact-attenuating member is arranged in a first orientation with respect to a longitudinal direction (heel-to-toe direction) of the foot-supporting member, and (ii) a second impact-attenuating member separate from the first impact-attenuating member, wherein the second impact-attenuating member is located at a rear, lateral heel portion of the foot-supporting member. The second impact-attenuating member, which may have the same general structure and/or construction as the first impact-attenuating member, may be arranged at a second, different orientation with respect to the longitudinal direction as compared to the first orientation (e.g., rotated as compared to the orientation of the first impact-attenuating member). The second impact-attenuating member may be designed and/or configured to provide less resistance to an impact force as compared with the first impact-attenuating member, due, at least in part, to the differences in their orientations. Also, other impact-attenuating members, when present, may be arranged in the first orientation. In accordance with at least some examples of this invention, the step landing impact-attenuating member (e.g., the rearmost, lateral heel impact-attenuating member) will be constructed or arranged (e.g., due to its orientation) to be softer than the posting and/or other impact-attenuating members in the heel area of the foot-receiving device.

Any number of impact-attenuating members may be provided in the sole structure, at any desired locations, without departing from the invention. For example, in some structures according to the invention, an impact-attenuating member may be provided: (a) in the lateral heel portion of the sole structure in front of the softer or less impact force resistant impact-attenuating member; (b) in the medial heel portion of the sole structure in front of the softer or less impact force resistant impact-attenuating member; (c) in the rear, medial heel portion (e.g., along side the softer or less impact force resistant impact-attenuating member); (d) along the arch portion; and/or (e) in the forefoot portion. In at least some example foot-receiving device structures according to this invention, some or all of the impact-attenuation member(s) may be included at locations and orientations so as to be at least partially visible from an exterior of the article of footwear, e.g., akin to commercial products available from NIKE, Inc., of Beaverton, Oreg. under the "SHOX" brand trademark. Alternatively, if desired, the impact-attenuation member(s) may be hidden or at least partially hidden in the overall footwear or foot-receiving device product structure, such as within the foam material of a midsole element, within a gas-filled bladder member, etc.

As described above, the second impact-attenuating member (e.g., the softer member, located at the landing position, etc.) may be arranged in a different orientation (e.g., a different angular orientation with respect to the longitudinal direction) as compared to at least some of the other impact-attenuating members present in the foot-receiving device structure. In some more specific example structures, at least one of the first and second impact-attenuating members may have an axial direction. The axial direction of the first impact-attenuating member, in the first orientation, may be arranged in any desired direction, such as substantially parallel to or substantially perpendicular to the longitudinal (heel-to-toe) direction (the term "substantially," as used in this context and unless otherwise noted, means±10° and it includes perfectly parallel or perfectly perpendicular, depending on the context of usage). In some more specific examples, the axial direction of the first impact-attenuating member may be arranged ±5° from perpendicular or parallel to the longitudinal direction of the foot-supporting member or foot-receiving device structure.

Similarly, the axial direction of the second impact-attenuating member may be arranged in any desired direction in the second orientation, including substantially parallel to or substantially perpendicular to the longitudinal direction. In other specific examples, the axial direction of the second impact-attenuating may be arranged to extend at an angle of 15° to 75° with respect to the longitudinal direction, and even at an angle of 25° to 65° or 30° to 60° with respect to the longitudinal direction. If desired, some or all of the impact-attenuating members may be movably (e.g., rotatably, slidably, etc.) mounted so as to allow one to change their orientation (e.g., angles of orientation) with respect to the longitudinal direction. In at least some examples of this invention, the different orientation of the second impact-attenuating member as compared to the first impact-attenuating member will cause the second member to be softer or less resistant to impact forces as compared to the first member.

Still additional aspects of this invention relate to foot-supporting members and/or impact-attenuation systems, e.g., sole structures or portions thereof, such as a heel unit or the like, that include two or more impact-attenuating members, e.g., of the various types, constructions, orientations, and/or relative characteristics described above. If desired, the various impact-attenuating members may be engaged with a common base member, e.g., to provide a structure that is insertable as a unit into an article of footwear or other foot-receiving device constructions. Such members and/or systems may have the relative orientation and/or impact-attenuating characteristics described above.

As noted above, the second impact-attenuating member (e.g., at the step landing area) may be oriented to provide less resistance to an impact force (e.g., when landing a step or jump) and/or to be "softer" as compared with the first impact-attenuating member (e.g., at the posting area). These characteristics may evince themselves in various ways. For example, in accordance with some examples of this invention, due at least in part to their orientations in the overall structure, the second impact-attenuating member (e.g., an impact-attenuating column) may experience more compression in the incident force direction, under a given incident force, as compared with compression of the first impact-attenuating member (e.g., an impact-attenuating column). As a more specific example, the second impact-attenuating member may compress at least 5% more in the incident force direction as compared with the first impact-attenuating member. In still other examples, the second impact-attenuating member may compress at least 10%, 15%, 20%, or even 25% more in the incident force direction as compared with the first impact-attenuating member. As another example, the speed of compression under an incident force may be used as a measure of an impact-attenuating member's "softness," e.g., wherein, due at least in part to their orientations in the overall structure, the second impact-attenuating member may fully compress (e.g., reach its maximum compression amount for a given incident force) at least 5%, or in some examples, 10%, 15%, 20%, or even 25% more rapidly than the first impact-attenuating member. Other ways of measuring the differences in impact-attenuation characteristics are possible without departing from this invention.

2. Methods of Making and Using Foot-Receiving Device Products According to the Invention Additional aspects of this invention relate to methods of making footwear or other foot-receiving device products including impact-attenuation members structured and/or arranged in accordance with examples of this invention and methods of using such impact-attenuation members and/or such products, e.g., for attenuating contact surface reaction forces. Such methods may include: (a) providing a foot-covering member, such as an upper member for an article of footwear (e.g., by making it in a conventional manner, obtaining it from another source, etc.); and (b) engaging a foot-supporting member (e.g., a sole structure) with the foot-covering member. As described above, the foot-supporting member (e.g., the sole structure) may include: (i) a first impact-attenuating member located in a heel portion and (ii) a second impact-attenuating member separate from the first impact-attenuating member, wherein the second impact-attenuating member is located at a rear, lateral heel portion (e.g., the step "landing" position) and wherein the second impact-attenuating member is oriented in a different manner (e.g., a different angular orientation with respect to a longitudinal (heel-to-toe) direction) as compared with the first impact-attenuating member. The different orientations may take on various different forms and may be provided in any desired manner, including, for example, the various forms and manners described above. The different orientations may be used to make the step landing impact-attenuating member or position softer and less resistant to impact forces as compared to the posting (or other) impact-attenuating member(s) or position(s).

Another example method of producing a foot-receiving device, such as an article of footwear, in accordance with this invention includes: (a) engaging an upper member with a sole structure, wherein the sole structure includes: (i) a first impact-attenuating member located in a heel portion of the sole structure and (ii) a second impact-attenuating member separate from the first impact-attenuating member, wherein the second impact-attenuating member is located at a rear, lateral heel portion of the sole structure (e.g., at a step landing location); and (b) arranging the second impact-attenuating member in a different orientation (e.g., a different angular orientation with respect to a longitudinal direction) as compared with the first impact-attenuating member, e.g., to make the second impact-attenuating member softer and/or less resistant to impact forces as compared to the first impact-attenuating member. Again, the different orientations may take on various different forms and may be provided in any desired manner, including, for example, the various forms and manners described above. The various steps may take place in any desired order or simultaneously without departing from this invention.

Once incorporated in an article of footwear or other foot-receiving device product structure, the article of footwear or other product may be used in its known and conventional manner, and the impact-attenuation members will attenuate the ground reaction forces (e.g., as a result of landing a step or jump). In some more specific examples, the article of footwear will constitute an athletic or training shoe, e.g., used for running, walking, other ambulatory and/or athletic activities, etc.

Specific examples of structures according to the invention are described in more detail below. The reader should understand that these specific examples are set forth merely to illustrate examples of the invention, and they should not be construed as limiting the invention.

D. SPECIFIC EXAMPLES OF THE INVENTION

The various figures in this application illustrate examples of impact-attenuation members, as well as products and methods according to examples of this invention. When the same reference number appears in more than one drawing, that reference number is used consistently in this specification and the drawings to refer to the same or similar parts throughout. In the description above and that which follows, various connections and/or engagements are set forth between elements in the overall structures. The reader should understand that these connections and/or engagements in general and, unless specified otherwise, may be direct or indirect and that this specification is not intended to be limiting in this respect.

FIG. 1 generally illustrates an example article of footwear 100 (e.g., athletic footwear) including multiple impact-attenuation members 102*a* and 102*b* in accordance with examples of this invention, examples of which will be described in more detail below. The article of footwear 100 includes an upper member 104 and a sole structure 106 engaged with the upper member 104 in any desired manner, including in conventional manners known and used in the art, such as by adhesives or cements; fusing techniques; mechanical connectors; stitching or sewing; and the like. Also, the upper member 104 and sole structure 106 may be made of any desired materials in any desired constructions, including with conventional materials and conventional constructions as are known and used in the art, including, for example, the materials and constructions used for footwear products available from NIKE, Inc. of Beaverton, Oreg. under the "SHOX" brand trademark. While the example footwear structure 100 of FIG. 1 illustrates the impact-attenuation members 102*a* and 102*b* in the heel area, those skilled in the art will appreciate that such impact-attenuation members 102*a*/102*b* may be included at any desired location(s) in any type of footwear 100 or foot-receiving device structure, including, for example, in the forefoot portion. Any number, arrangement, and/or style of impact-attenuation members 102*a*/102*b* may be included in a footwear structure 100 without departing from this invention.

Also, while the illustrated footwear structure 100 shows the impact-attenuation members 102*a*/102*b* open and exposed at the footwear exterior, those skilled in the art will recognize that the impact-attenuation members 102*a*/102*b* may be covered or partially covered (e.g., at least partially embedded within a midsole (e.g., foam) or other portion of the sole or foot-supporting structure, at least partially enclosed by a restraining member structure, at least partially engaged with a fluid-filled bladder member, etc.) without departing from this invention.

Figure 2A:
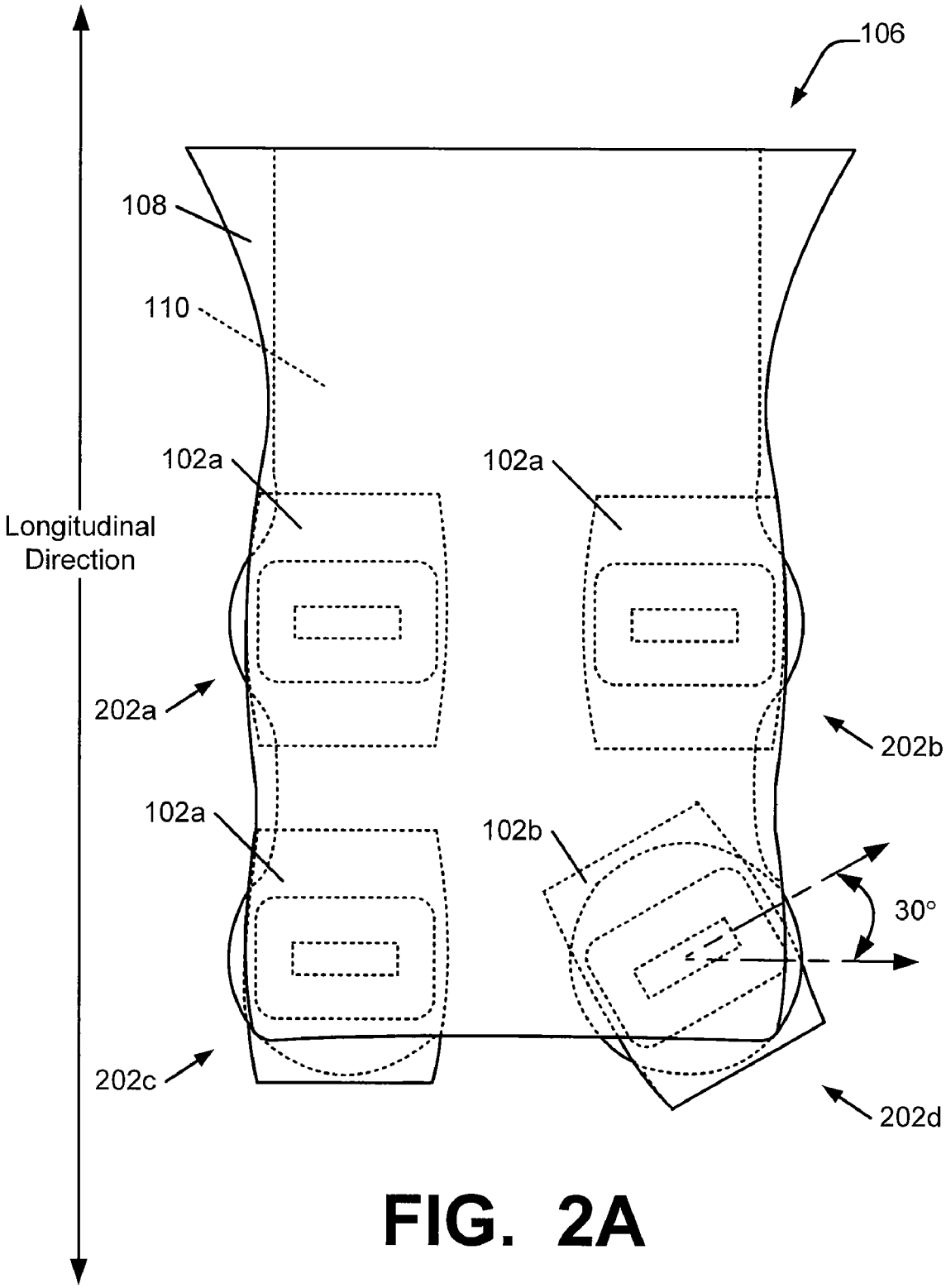
FIGS. 2A through 2C illustrate overhead views of arrangements of impact-attenuation elements in articles of footwear in accordance with some examples of this invention.
Figure 2B:
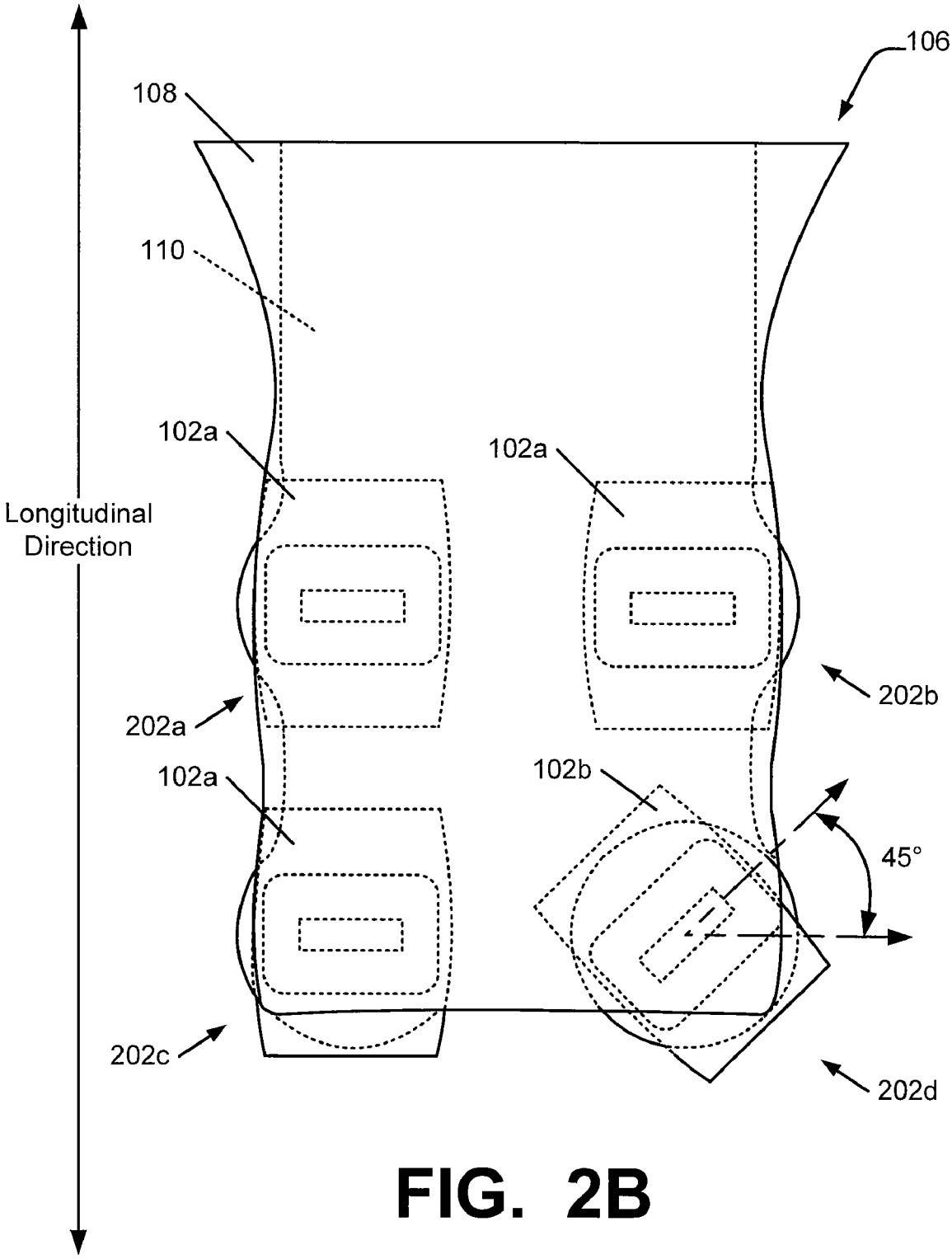
Figure 2C:
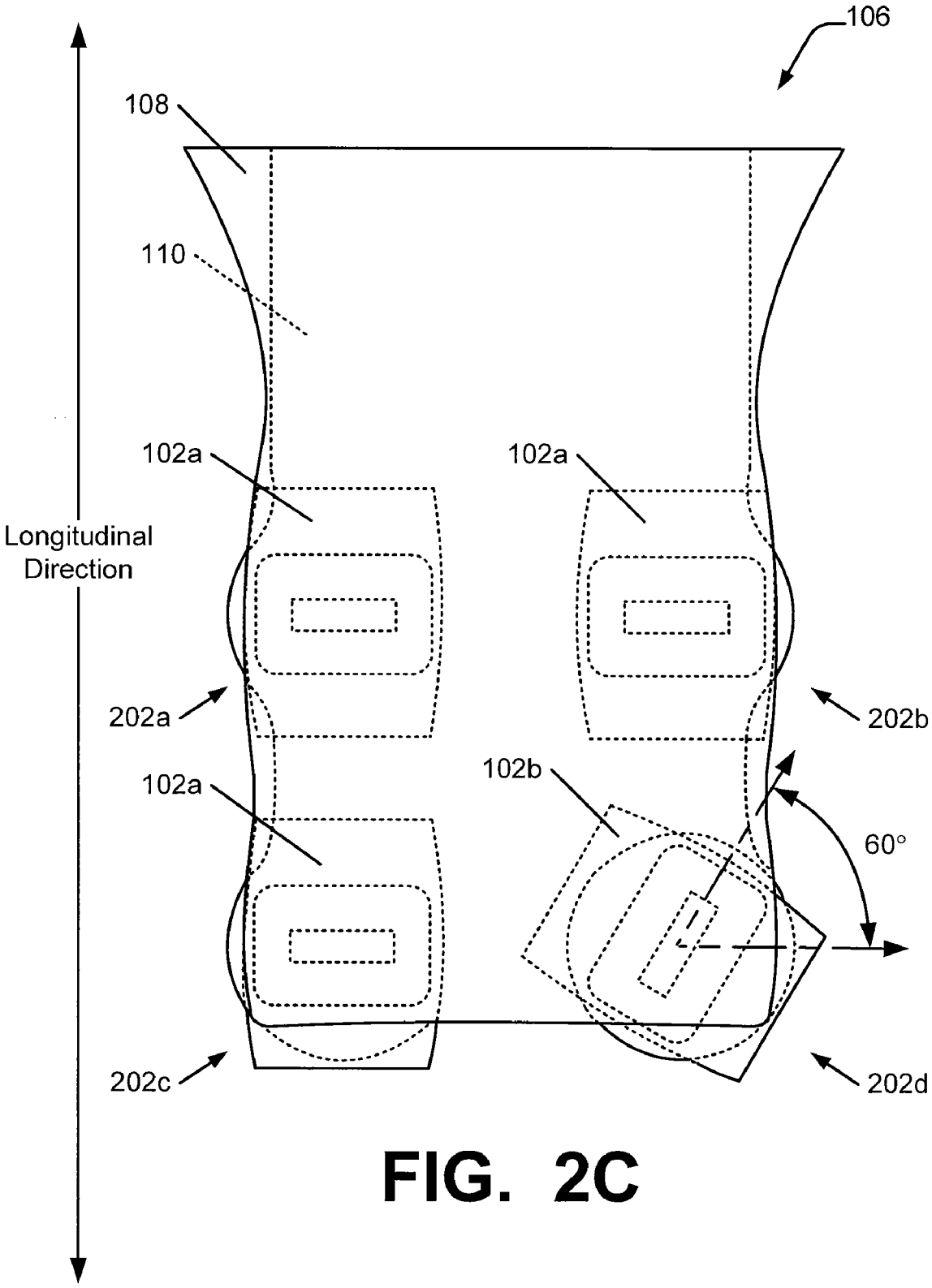

FIGS. 2A through 2C illustrate overhead views of the heel area of a sole structure 106, like that illustrated in FIG. 1. As shown (and also shown in FIG. 1), the heel area of this example structure 106 includes a top base or plate member 108 and a bottom base or plate member 110, with plural impact-attenuating members 102*a* and 102*b* extending between the top base member 108 and the bottom base member 110. The base members 108 and 110 may be made in any desired shapes and constructions, from any desired materials and/or numbers of independent pieces, without departing from this invention, including in conventional shapes and/or from conventional constructions, materials, and parts known and used in the art (e.g., in conventional footwear products available from NIKE, Inc. of Beaverton, Oreg. under the "SHOX" brand trademark). As more specific examples, each of the base members 108 and 110 may constitute a one (or more) piece member produced from a rigid plastic material, such as PEBAX® (a polyether-block co-polyamide polymer available from Atofina Corporation of Puteaux, France), one or more members produced from fiber-reinforced plastic or composite materials, one or more members produced from particle-reinforced plastic or composite materials, etc. Metal-containing base members 108 and/or 110 also may be used without departing from this invention. The base members 108 and 110 may constitute at least a portion of the footwear structure 100, such as part of a footwear midsole member, part of a footwear outsole member, etc. Also, while any number of impact-attenuating members 102*a* and/or 102*b* may be included in a footwear structure 100, in this illustrated example, the sole structure 106 includes four individual and distinct impact-attenuating members 102*a* and 102*b*, one impact-attenuating member supporting each of the four "corners" of the wearer's heel, namely, the front medial "corner" 202*a*, the front lateral "corner" 202*b*, the rear medial "corner" 202*c*, and the rear lateral "corner" 202*d*.

In the example structures 100 and 106 illustrated in FIGS. 1 through 2C, the impact-attenuating members 102*a* and 102*b* generally have the same size, shape, and/or other appearance characteristics. While the impact-attenuating members 102*a* may have substantially the same general impact-attenuation properties and characteristics (as indicated by their common reference number in these figures), the impact-attenuating member 102*b* located in the rear lateral corner 202*d* (or one or more impact-attenuating members located most proximate to the rear lateral corner 202*d*) differs in its orientation from at least some of the others, as shown in FIGS. 2A through 2C. More specifically, in accordance with some examples of this invention, the impact-attenuating member 102*b* located in the rear lateral corner 202*d* (or most proximate to the rear lateral corner 202*d*) will provide less resistance to an impact force (e.g., from landing a step or jump) as compared with at least some of the other impact-attenuating members 102*a*. The difference(s) in resistance to impact forces may be provided by orienting impact-attenuating member 102*b* in a different manner as compared to at least some of the other impact-attenuating members 102*a*.

As described above, in a typical step, the foot's first contact location with the contact surface is at the lateral rear heel area (e.g., in area 202*d* or the "landing" post 102*b* in FIGS. 2A through 2C). By making the rear lateral impact-attenuating member 102*b* somewhat less resistant to impact forces when landing a step or jump as compared to at least some of the other impact-attenuating members 102*a* (e.g., particularly the "posting" impact-attenuating member or position, the forward lateral impact-attenuating member 102*a*, and/or other impact-attenuating members located on the lateral side, etc.), the foot has a better opportunity to naturally turn to the proper position as the step continues, thereby reducing the likelihood of over-pronation.

While the illustrated example sole structure 106 shows the impact-attenuating members 102*a* as having the same general sizes, shapes, orientations, appearances, and/or impact-attenuation characteristics, this is not a requirement. If desired, any or all of the impact-attenuating members 102*a* may have different sizes, shapes, orientations, appearances, and/or impact-attenuation characteristics. Alternatively, if desired, some or all of the impact-attenuating members 102*a* may have the same sizes, shapes, orientations, appearances, impact-attenuation characteristics, etc. Also, if desired, the rear lateral impact-attenuation member 102*b* may have the same general size, shape, and/or appearance as compared to the other impact-attenuating members 102*a*, but with different impact-attenuation characteristics with respect to at least some of the impact-attenuating members 102(*a*) (e.g., those on the lateral side), e.g., due to its differing orientation. As illustrated in FIGS. 2A through 2C, the rear, lateral impact-attenuating member 102*b* may be "rotated" somewhat as compared with at least some of the other impact-attenuating members 102*a* (e.g., like those on the lateral side). While any degree of rotation or other change in orientation is possible without departing from the invention, FIG. 2A shows element 102*b* rotated 30° as compared with impact-attenuating members 102*a*, FIG. 2B shows a 45° rotation, and FIG. 2C shows a 60° rotation. The relative degree of rotation in some structures may vary between 15° to 75°, 25° to 65°, or even between 30° to 60° in some examples. Also, if desired, the impact-attenuating member 102*b* (as well as members 102*a*) may be movably mounted and selectively lockable in the footwear structure, e.g., to allow user or other selection and customization of the rotational angle of member 102*b* at any desired 360° rotational position. While some of the other impact-attenuating members 102*a* in a footwear structure may have the same or similar impact-attenuation characteristics as impact-attenuation member 102*b*, in at least some example footwear structures 100, impact-attenuation member 102*b* will have a lower resistance to impact forces as compared to some or all of the other impact-attenuation members 102*a* in the footwear structure 100, e.g., due at least in part to its orientation (e.g., angular position as compared to the open impact-attenuating members 102*a*).

Figure 3:
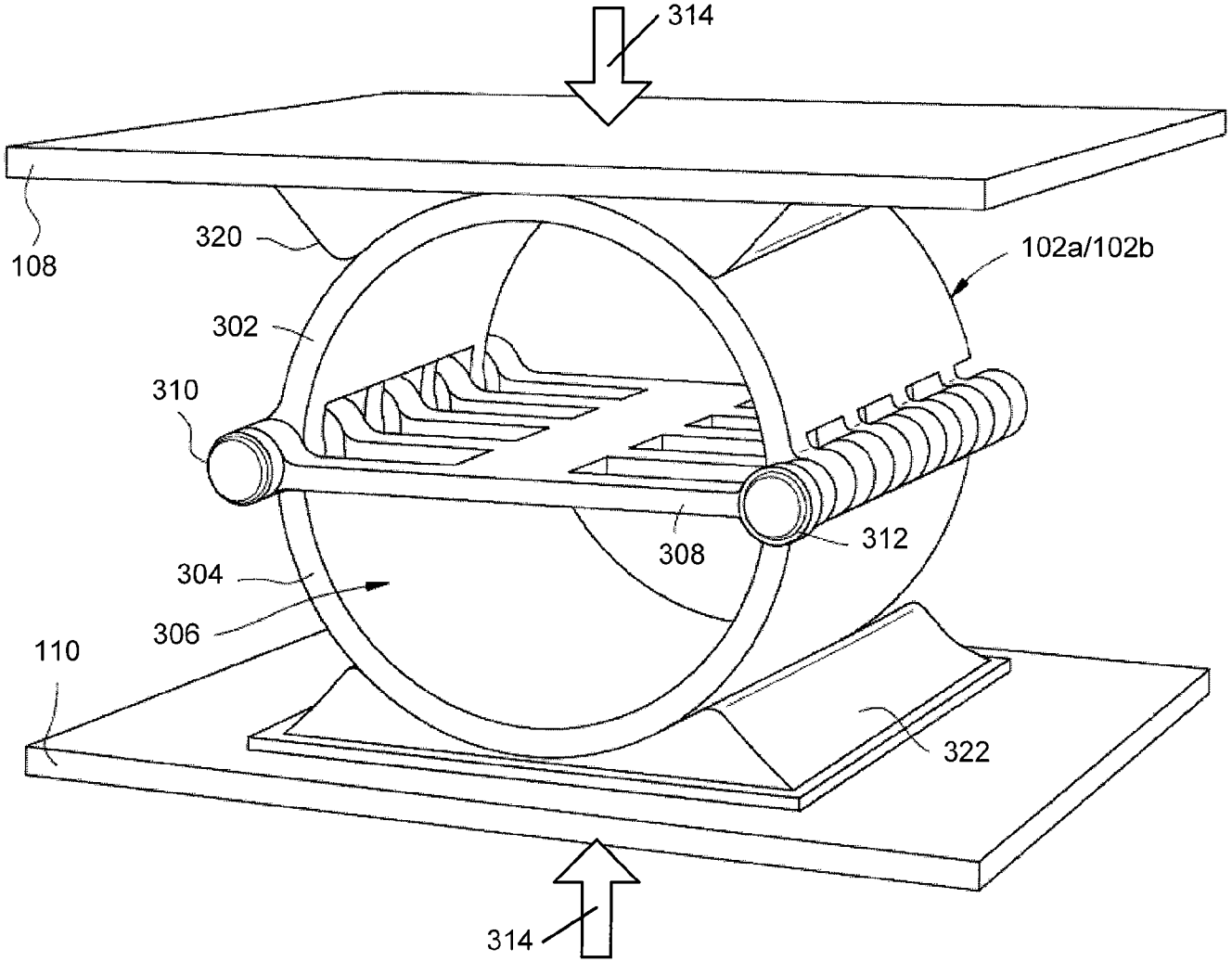

The impact-attenuating members 102*a* and/or 102*b* may have a wide variety of different constructions and shapes without departing from this invention. Some impact-attenuating members 102*a* and/or 102*b* may include a spring member or other tensioned element that stretches when an impact force is applied to the shoe (e.g., when landing a step or a jump). FIG. 3 illustrates an example of such an impact-attenuating member 102*a* and/or 102*b* mounted between two base members 108 and 110. For clarity and ease of illustration, only a single impact-attenuating member 102*a*/102*b* is illustrated in FIG. 3. Of course, as mentioned above, any number of impact-attenuating members 102*a*/102*b* may be provided in a footwear structure 100 without departing from this invention.

The example impact-attenuating element 102*a*/102*b* of FIG. 3 includes a first body or housing portion or member 302 and a second body or housing portion or member 304, wherein the body members 302 and 304 are arranged facing one another such that an open space 306 is defined between them. The body members 302 and 304 may be arched, semi-circular, semi-elliptical, hemispherical, semi-oval (optionally with a flat or substantially flat top edge), etc., in shape so as to provide an area for open space 306. Any suitable or desired shapes or orientations may be used without departing from this invention. The body members 302 and 304 may be made from any suitable material, such as plastic, elastomeric, or polymeric materials capable of changing shape, size, and/or orientation when a force is applied thereto and returning back to or toward their original shape, size, and/or orientation when the force is relieved or relaxed. As more specific examples, the body members 302 and 304 (as well as the body members of other examples described in this specification) may be made from a polymeric material, such as PEBAX® (a polyether-block co-polyamide polymer available from Atofina Corporation of Puteaux, France). If desired, a single piece body member may be used that includes body portions defining an open area, or the individual body members 302 and/or 304 each may be constructed from multiple pieces, without departing from this invention.

The body members 302 and 304, at least in part, define a base or neutral orientation (e.g., an orientation at which no significant external forces are applied to the device 102*a*/102*b* other than forces applied by the components of the device 102*a*/102*b* and/or the components of the footwear or other foot-receiving device in which it is mounted). A spring member 308 extends across and is at least partially included in the open space 306. In the base orientation, as illustrated in FIG. 3, the spring member 308 may tautly extend across the open space 306 at essentially a central location between the body members 302 and 304, although other locations and/or orientations are possible. Any suitable or desired spring member 308 design or orientation may be used in the device 102*a*/102*b* without departing from this invention. In this illustrated example, the spring member 308 is a synthetic or natural rubber or polymeric material (such as an elastomeric material) that is capable of stretching somewhat under tensile force and then returning (or substantially returning) to or toward its original size and shape when the force is relieved or relaxed. As more specific examples, the spring member 308 (as well as spring members of other examples described in this specification) may be made from a polymeric material, such as DESMOPAN® (a thermoplastic polyurethane material available from Bayer AG of Leverkusen, Germany). The size, construction, orientation, material, and/or other properties of the spring member 308 may be freely selected and varied to change the overall stiffness or resistance to impact forces (and thereby provide devices 102*a* and 102*b* for the various different locations in a footwear structure).

The spring member 308 may be molded to or otherwise engaged with respect to at least one of the body members 302 and/or 304 in a variety of manners, such as in a pivotal, rotatable, or hinged manner. In the example illustrated in FIG. 3, the spring member 308 is pivotally connected to both body member 302 and body member 304, at multiple locations, by two pivot shafts 310 and 312 (e.g., the shafts 310 and 312 extend through openings defined along the connecting edges of body member 302, body member 304, and spring member 308). The pivot shafts 310 and 312 may be made of metal, plastic, composites, and/or any other suitable or desired material. Using this arrangement, when a force 314 is applied to at least one of the body members 302 or 304 in a first direction (e.g., a compressive vertical force 314 resulting from landing a step or jump that tends to reduce at least one dimension of the open space 306) so as to change the device 102*a*/102*b* from its base orientation to a compressed orientation, the spring member 308 will stretch. In this manner, the compressive force 314 may be attenuated, thereby causing a displacement in another direction (e.g., a stretch of spring member 308 due to separation of pivot shafts 310 and 312). The spring member 308 may remain stretched while the load 314 is applied. The pivotal or hinged connection allows the body members 302 and 304 and the spring member 308 to more freely move with respect to one another and helps prevent stresses induced by the compressive force 314 from breaking or damaging one of the body members 302 or 304 or the spring member 308, particularly at or near their points of connection. When the load 314 is relieved or relaxed, the spring member 308 will return to (or substantially return to) its original size and shape, which tends to pull the body members 302 and 304 inward, thereby returning the impact-attenuating member 102*a*/102*b* to its original orientation (or at least back toward its original orientation). Material characteristics of the body members 302 and 304 (e.g., their thermoplastic construction in some examples) also may help return the body members 302 and 304 to their original orientation.

FIG. 3 illustrates the impact-attenuating member 102*a*/102*b* mounted or included between two bases or plates 108 and 110. Optionally, if desired, flexible interfaces 320 and 322 (such as foam material) may be provided between the bases 108 and 110 and the body members 302 and 304 of the device 102*a*/102*b*. These flexible interfaces 320 and 322 may be capable of changing shape when the compressive forces 314 are applied, e.g., when the body members 302 and 304 flatten out under the compressive force 314. The flexible interfaces 320 and 322 may provide additional support and/or impact attenuation properties.

The bases 108 and 110 and optional flexible interfaces 320 and 322 may form an integral part of a piece of footwear or other device in which one or more devices 102*a*/102*b* may be mounted or included. Alternatively, the bases 108 and 110 and optional flexible interfaces 320 and 322, along with one or more impact-attenuating members 102*a*/102*b*, may be included as part of a unitary construction (e.g., as a "heel cage" unit) that may be inserted as a unit into a footwear structure. The flexible interfaces 320 and 322 may be attached to their respective bases 108 and 110, if desired, and/or the body members 302 and 304 may be attached to their respective interfaces 320 and 322, if desired, and/or the body members 302 and 304 may be attached to their respective bases 108 and 110, in any suitable manner, such as through mechanical connectors; adhesive connections; tight, friction fits; fusing techniques; retaining member structures; or the like.

As noted above, a difference in impact-attenuating characteristics (e.g., resistance to incident forces from landing a step or jump) between devices 102*a* and 102*b* may be provided by orienting device 102*b* somewhat different from devices 102*a* in an overall footwear structure (e.g., rotationally offset as shown in FIGS. 2A through 2C). Additionally, if desired, additional differences in the impact-attenuating characteristics between devices 102*a* and 102*b* may be provided in a wide variety of different manners without departing from this invention, optionally while still providing impact-attenuating members 102*a*/102*b* having the same general size, shape, appearance, etc. For example, the spring member 308 of device 102*b* may be made thinner, with more open space, with narrower arms, with fewer arms, and/or of a stretchier material, etc., as compared with the spring member 308 included in devices 102*a*. As additional or alternative examples, if desired, one or more of the body members 302 and/or 304 and/or flexible interfaces 320 and/or 322 in devices 102*b* may be made thinner, with more open space, with a higher void percentage, and/or of a more flexible material, etc., as compared with the body member(s) 302 and/or 304 and/or flexible interfaces 320 and/or 322 in devices 102*a*.

Figure 4:
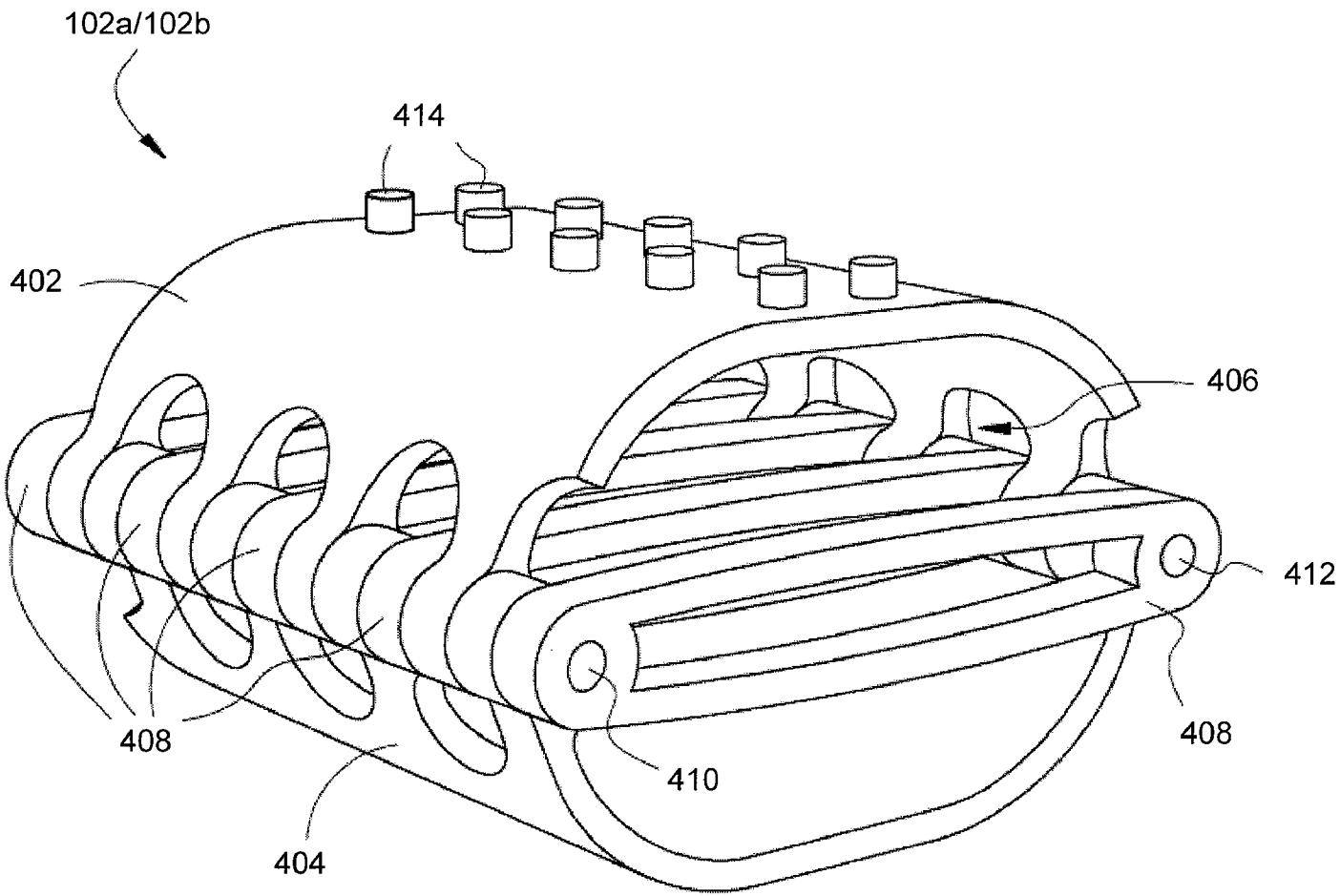

FIG. 4 illustrates another example of an impact-attenuating member 102*a*/102*b* that may be used in accordance with aspects of this invention. As illustrated in FIG. 4, the impact-attenuating member 102*a*/102*b* includes a first body portion or member 402 and a second body portion or member 404 shaped and oriented so as to face one another and to provide an open area 406 therebetween. In this example structure 102*a*/102*b*, the body members 402 and 404 are more semi-oval or semi-elliptical shaped in their base orientation as compared to the more rounded body members 302 and 304 of FIG. 3. Also, in this example structure 102*a*/102*b*, plural independent spring or tension members 408 are provided and extend across the open area 406 at a central location between the body members 402 and 404. The spring members 408 are pivotally or hingedly mounted with respect to both body members 402 and 404 along their respective connecting edges by shafts 410 and 412 in a manner generally similar to that illustrated in FIG. 3. Additionally, when a compressive force is applied to the body members 402 and 404, the impact-attenuating member 102*a*/102*b* and spring members 408 operate in a similar manner to impact-attenuating member 102*a*/102*b* and spring member 308 described above.

While not a requirement, all of the spring members 408 in this example structure 102*a*/102*b* are identically shaped and sized, although different shapes, sizes, strengths, and materials may be used for the individual spring members 408 without departing from the invention (and/or in order to provide differences in the impact-attenuation characteristics (e.g., different resistance to impact forces) between impact-attenuating members 102*a* and 102*b*). Additionally, although FIG. 4 illustrates all of the spring members 408 arranged in parallel, in a common plane or orientation across essentially the center of the impact-attenuating member 102*a*/102*b*, any suitable or desired arrangement or orientation of the spring members 408 may be used without departing from this invention, including arrangements in different planes and/or in a non-parallel manner.

Additional features available in accordance with at least some examples of this invention are illustrated in FIG. 4. For example, each of the body members 402 and 404 in this illustrated example structure 102*a*/102*b* include mountings members 414. These mounting members 414 (e.g., pins 414 in the illustrated example) may be used to fix the locations of the body members 402 and 404 with respect to base members 108 and 110 (base members 108 and 110 are not shown in FIG. 4, but they may be arranged in a manner similar to that shown in FIGS. 1-3) or other mounting substrate. Optionally, if desired, an adhesive or cement, e.g., on mounting members 414, on base members 108 and/or 110 (or other mounting substrate), and/or on body members 402 and 404, or other suitable connection means or mechanism may be used to further secure the body members 402 and 404 to their respective base member 108 and 110 (or other mounting substrate), if desired. While the mounting pins 414 are shown as round pegs in FIG. 4, any suitable or desired structure, position, shape, number, or size for the attachment elements 414 may be used without departing from the invention. For example, if desired, the outer surface of the body members 402 and 404 may include one or more raised ribs that fit into slots, tracks, or openings formed in the base members 108 and 110 or other mounting substrates, and/or vice versa.

Additionally or alternatively, pins 414 or ribs of the types described above also may be used to control and/or fine tune the stiffness of the overall impact-attenuating member 102*a*/102*b*. For example, providing ribs or pins 414 as described above may stiffen the body members 402 and/or 404 somewhat while adding less overall weight to the impact-attenuating member 102*a*/102*b* as compared to making the entire body members 402 and/or 404 thicker in an effort to provide additional stiffness.

The difference in impact-attenuating characteristics (e.g., resistance to incident impact forces from landing a step or jump) between devices 102*a* and 102*b* may be provided by orienting device 102*b* somewhat different from devices 102*a* in an overall footwear structure (e.g., rotationally offset, as shown in FIGS. 2A through 2C). Additionally, if desired, additional differences in the impact-attenuating characteristics between devices 102*a* and 102*b* may be provided in a wide variety of different manners without departing from this invention, optionally while still providing impact-attenuating members 102*a*/102*b* having the same general size, shape, appearance, etc. For example, at least some of the spring members 408 of impact-attenuating members 102*b* may be made thinner, with more open space, with narrower arms, and/or of a stretchier material, etc., as compared with the spring members 408 included in devices 102*a*. As additional or alternative examples, if desired, fewer spring members 408 may be included in impact-attenuating members 102*b* as compared to members 102*a*. As still additional examples or alternatives, one or more of the body members 402 and/or 404 in devices 102*b* may be made thinner, with more open space, with fewer or no reinforcing ribs or structures, and/or of a more flexible material, etc., as compared with the body member(s) 402 and/or 404 in devices 102*a*.

Figure 5:
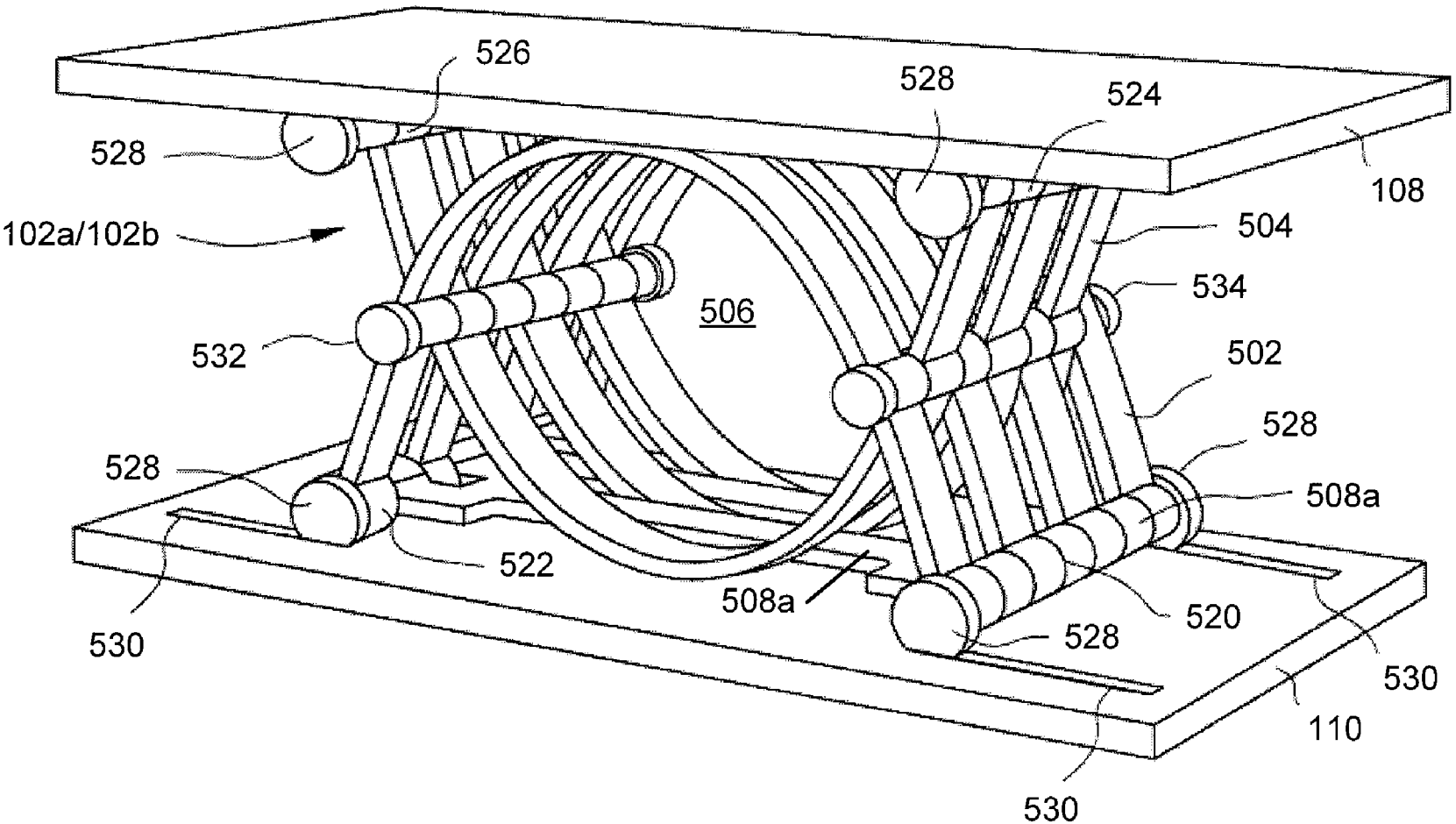

FIG. 5 illustrates another example of impact-attenuating members 102*a*/102*b* that may be used in accordance with some examples of this invention. In this example structure 102*a*/102*b*, the body members and spring members of the impact-attenuating members 102*a*/102*b* are arranged somewhat differently from those described above. Specifically, in this example structure 102*a*/102*b*, each body portion or member 502 and 504 is semicircular, semi-oval, or semi-elliptical shaped and extends the entire distance between the base members 108 and 110 or other mounting substrates (in the examples of FIGS. 3 and 4, each body portion or member spanned only about one half of that distance). Moreover, in this example, the impact-attenuating member 102*a*/102*b* includes a plurality of independent body members 502 and 504 oriented in parallel in each direction.

An open space 506 is defined between the various body portions or members 502 and 504, and spring member 508*a* extends through this open space 506. Spring member 508*a* is pivotally or hingedly engaged with respect to body member(s) 502 via shafts 520 and 522 and extends through the open area 506 at a location proximate to base member 110. A similar spring member is pivotally or hingedly engaged with respect to body member(s) 504 via shafts 524 and 526 and extends through the open area 506 at a location proximate to base member 108. The ends of shafts 520, 522, 524, and 526 may include slide or rotational wheels 528 that engage tracks 530 in base members 108 and 110 (or other mounting substrates). Furthermore, the body members 502 and 504 may be pivotally or hingedly engaged with respect to one another via shaft members 532 and 534.

When a compressive force is applied to plates 108 and/or 110 (e.g., from landing a step or jump), this causes the body members 502 and 504 to flatten out (e.g., displace in a horizontal direction) as the wheels 528 slide or roll away from one another along tracks 530. This compressive force also causes the spring member 508*a* and its complementary spring member located at the top of the member 102*a*/102*b* to stretch. When the compressive force is relaxed or relieved, the stretched spring members will return toward their original orientation, thereby pulling the attached body members 502 and 504 with them and returning the impact-attenuating members 102*a*/102*b* back toward its original orientation. The material of the body members 502 and 504 also may be selected such that it tends to return to or toward its original orientation when the compressive force is relaxed or relieved.

Of course, many alternatives are possible to the construction illustrated in FIG. 5 without departing from the invention. For example, while the impact-attenuating members 102*a*/102*b* include plural body portions or members 502 and 504 oriented in parallel in each direction, each parallel set of the body members 502 and 504 could be made as a one piece construction, if desired. Additionally or alternatively, while FIG. 5 illustrates the spring member 508*a* as a one piece construction, plural spring members may be used without departing from the invention (akin to the structure of FIG. 4). As potential additional alternatives, spring member 508*a* (and its corresponding partner at the top of the structure) may be arranged outside of body members 502 and 504 such that they do not pass through the open area 506, particularly if body members 502 and 504 are formed as a single piece. The various body members 502 and 504 also need not be arranged in a regular, alternating pattern. The various components of the impact-attenuating members 102*a*/102*b* may be made of any suitable or desired materials, like the various materials described for similar elements above.

The difference in impact-attenuating characteristics (e.g., resistance to incident impact forces from landing a step or jump) between devices 102*a* and 102*b* may be provided as described above in conjunction with FIGS. 2A through 2C by orienting devices 102*b* different from devices 102*a* in the overall footwear structure (e.g., rotationally offset). Additionally, if desired, additional differences in the impact-attenuating characteristics between devices 102*a* and 102*b* may be provided in a wide variety of different manners without departing from this invention, optionally while still providing impact-attenuating members 102*a*/102*b* having the same general size, shape, appearance, etc. For example, one or more of the spring member(s) 508*a* may be made thinner, with more open space, with narrower arms, and/or of a stretchier material, etc., in impact-attenuating member 102*b* as compared with the spring member(s) 508*a* included in impact-attenuating member 102*a*. As additional or alternative examples, if desired, fewer spring members 508*a* may be included in impact-attenuating members 102*b* as compared to members 102*a* (e.g., in structures in which each spring member 508*a* constitutes several independent parts). As still additional examples or alternatives, one or more of the body members 502 and/or 504 in devices 102*b* may be made thinner, narrower, with more open space, and/or of a more flexible material, etc., as compared with the body member(s) 502 and/or 504 in devices 102*a*. As another example or alternative, if desired, devices 102*b* may include fewer body members 502 and/or 504 as compared with devices 102*a*.

Figure 6:
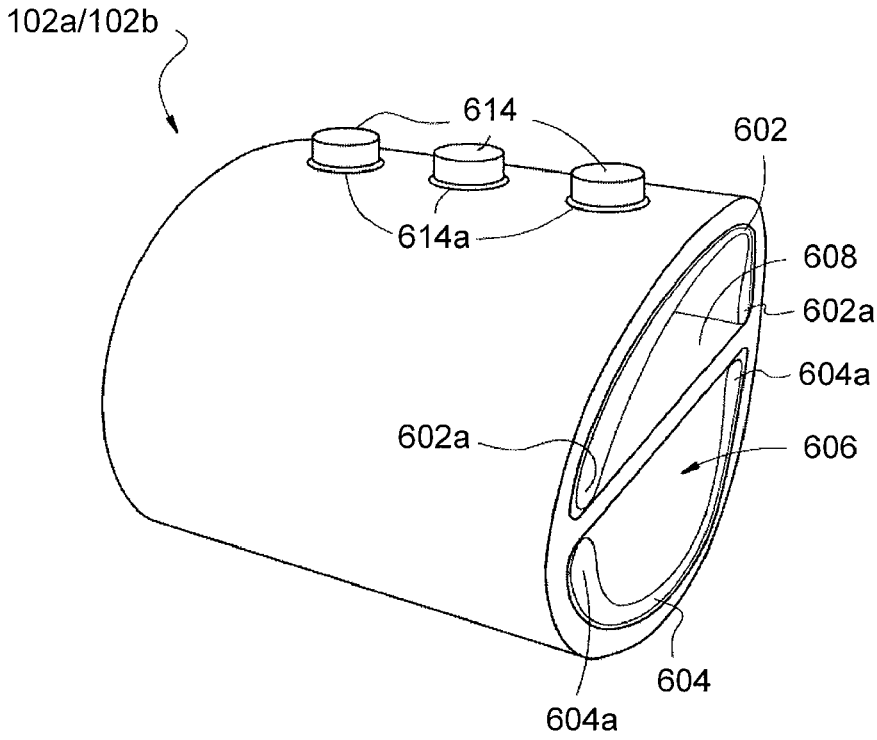

FIG. 6 illustrates another example impact-attenuation member structure 102*a*/102*b* that may be used in accordance with some examples of this invention. In this example structure 102*a*/102*b*, arched body portions or members 602 and 604 are arranged facing one another such that an open space 606 is defined therebetween. A stretchable spring member 608 extends through the open space 606 and engages (e.g., movably engages, such as rotatably or pivotally) the rounded ends 602*a* and 604*a* of the body members 602 and 604, respectively. The spring member 608 in this example structure 102*a*/102*b* further extends outside the open space 606 and around the exterior surfaces of the body members 602 and 604 so as to at least partially, and in some examples, so as to substantially, enclose or contain the body members 602 and 604 (e.g., the terms "substantially enclose" or "substantially contain" in this context, mean that the spring member 608 extends around and encloses or covers at least 50% of the outer surface area of body members 602 and 604). In the illustrated example structure 102*a*/102*b*, the spring member 608 encloses or covers substantially the entire exterior surface area of body members 602 and 604 (e.g., greater than 75% of the exterior surface area, and even greater than 90% or 95% of the exterior surface area). In some example structures, at least a sufficient portion of the exterior surface areas of body members 602 and 604 will be covered by the spring member 608 to securely hold the various pieces together as a unitary structure 102*a*/102*b* (e.g., to maintain a stable chemical or adhesive junction, a stable frictional fit, etc.).

The body members 602 and 604 may be made from any suitable or desired materials, such as plastic, elastomeric, or polymeric materials capable of changing shape, size, and/or orientation when a force is applied thereto and returning back to or toward their original shape, size, and/or orientation when the force is relieved or relaxed (e.g., a PEBAX® material (a polyether-block co-polyamide polymer available from Atofina Corporation of Puteaux, France)). If desired, a single or one-piece body member structure may be used that includes body portions that define an open area 606, or the individual body members 602 and/or 604 each may be constructed from multiple pieces, without departing from this invention. Also, those skilled in the art will appreciate that the body members 602 and/or 604 may be semicircular, semi-oval, semi-elliptical, hemispherical, and/or other shapes, including other arched shapes, without departing from this invention. If desired, the various "arched" structures described above may include flat or substantially flat top and/or bottom portions, e.g., to facilitate engagement with or mounting to other structures, such as base members 108 and/or 110 for articles of footwear.

Any suitable or desired spring member 608 structure and/or orientation may be included in the impact-attenuation member 102*a*/102*b* of FIG. 6 without departing from this invention. In this illustrated example, the spring member 608 is a synthetic or natural rubber or polymeric material (such as an elastomeric material) that is capable of stretching under tensile force and then returning (or substantially returning) to or toward its original size and shape when the force is relieved or relaxed. As a more specific example, the spring member 608 may be made from a polymeric material, such as DESMOPAN® (a thermoplastic polyurethane material available from Bayer AG of Leverkusen, Germany).

The spring member 608 may be molded to or otherwise engaged with respect to at least one of the body members 602 and/or 604, as noted above, optionally in a relatively movable manner (e.g., pivotal or rotatable manner). In the example structure 102*a*/102*b* illustrated in FIG. 6, when a force is applied that compresses body members 602 and 604 together and toward one another (e.g., when a wearer lands a step or jump), the rounded ends 602*a* and 604*a* of these body members 602 and 604, respectively, pinch together and pivot or rotate somewhat with respect to the spring member 608, which stretches the spring member 608 outward under the force of the pinching and flattening body members 602 and 604. When the compressive force is relieved or relaxed, the spring member 608 tends to constrict back to or toward its original orientation and configuration, thereby, in at least some instances, pulling body members 602 and 604 (as well as the overall impact-attenuation member 102*a*/102*b*) back to or toward their original or base orientations and configurations. The material and structure of the body members 602 and 604 also may assist in bringing the overall structure 102*a*/102*b* back to or toward its original orientation.

The exterior body portion of spring member 608 in the illustrated example includes openings or holes 614*a* defined therein so that mounting elements 614, e.g., pins 614, optionally included on the exterior surface of the body members 602 and/or 604, may extend through the spring member 608 and may be used to fix the position of the impact-attenuation member 102*a*/102*b*. For example, these mounting elements 614 may fit into holes defined in base members 108 and/or 110 (see FIG. 1) or other mounting substrates so that the impact-attenuation members 102*a*/102*b* can be securely mounted with respect to the base members 108 and/or 110 or other mounting substrate(s).

Rather than being included as part of the body members 602 and 604, the mounting elements 614, if any, may be formed as part of the spring member 608 and/or they may be separate elements attached to the spring member 608 and/or the body member structures 602 and 604 in some manner. Additionally, the mounting elements 614 may be constructed of any suitable or desired material, in any desired shape, and/or provided at any desired locations, without departing from the invention. For example, the mounting elements 614 may be formed as ribs that are received in tracks, grooves, or openings defined in base members 108 and/or 110 or other mounting substrates, and/or vice versa.

The difference in impact-attenuating characteristics (e.g., resistance to incident impact forces from landing a step or jump) between devices 102*a* and 102*b* may be provided by orienting device 102*b* somewhat different from devices 102*a* in an overall footwear structure (e.g., rotationally offset, as shown in FIGS. 2A through 2C). Additionally, if desired, additional differences in the impact-attenuating characteristics between devices 102*a* and 102*b* may be provided in a wide variety of different manners without departing from this invention, optionally while still providing impact-attenuating members 102*a*/102*b* having the same general size, shape, appearance, etc. For example, at least some portions of the spring member 608 of impact-attenuating members 102*b* may be made thinner (e.g., across open space 606) and/or of a stretchier material, etc., as compared with the spring members 608 included in devices 102*a*. As additional examples or alternatives, one or more of the body members 602 and/or 604 in devices 102*b* may be made thinner, with open space, and/or of a more flexible material, etc., as compared with the body member(s) 602 and/or 604 in devices 102*a*. As additional examples or alternatives, if desired, devices 102*a* may include additional or more support members to reinforce the body members 602 and/or 604 as compared with the body members 602 and/or 604 included in devices 102*b*.

Figure 7A:
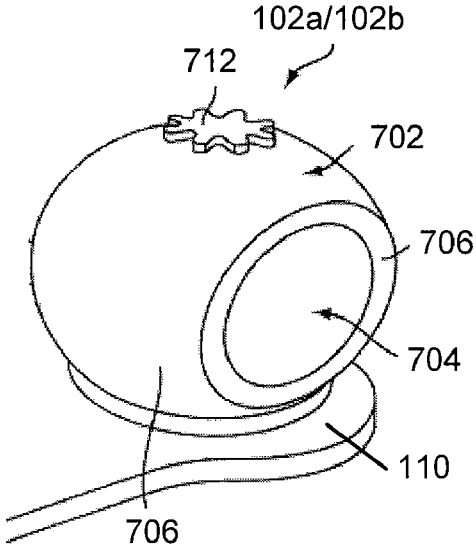
Figure 7B:
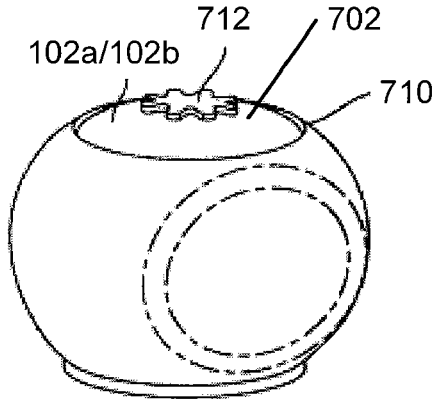

FIGS. 7A and 7B illustrate additional example impact-attenuation member structures 102*a*/102*b* that may be used in accordance with at least some examples of this invention. In this example structure 102*a*/102*b*, a shear resistant/impact-attenuating body member 702 is provided, made, for example, of a rigid material, like those described above (such as PEBAX®, a polyether-block co-polyamide polymer available from Atofina Corporation of Puteaux, France). The body member 702 in this illustrated example is a continuous, single structure substantially spheroid or ellipsoid shaped, but two opposing sides of the spheroid or ellipsoid have been left open, removed, or truncated. Also, a through hole 704 is defined between the open opposing sides (or alternatively, the opposing sides provide access to an at least partially hollow interior structure of the spheroid or ellipsoid member). If desired, the hole 704 need not extend completely through the body member 702 (e.g., it may extend from each truncated side wall and stop near the center of the body member 702).

When mounted in an article of footwear, the structure 102*a* may provide both impact-attenuating and shear resistance properties (i.e., resistance to failure or toppling in response to forces in the lateral-to-medial side direction). More specifically, because of the at least partially open structure (e.g., including through hole 704 in this illustrated example structure 102*a*), the rigid material of the body member 702 may flex somewhat in response to vertical forces and/or forces experienced when landing a step or jump. Additionally, because of the relatively wide opposing wall structures 706 present in the footwear side-to-side direction for impact-attenuating members 102*a* (e.g., the direction of through hole 704), lateral stability and resistance to lateral or shear forces are provided (e.g., to provide stability when a wearer quickly stops, cuts, or changes directions in the shoe).

Various other potential example features of structures in accordance with this invention are illustrated in FIGS. 7A and 7B. While these features are described and discussed in conjunction with the example structure 102*a*/102*b* illustrated in FIGS. 7A and 7B, those skilled in the art will appreciate that some or all of these various features also may be used in conjunction with other impact-attenuation member structures without departing from this invention, including, for example, the various structures described above in conjunction with FIGS. 1 through 6.

FIG. 7B illustrates that the overall impact-attenuation member 102*a*/102*b* further may include a restraining member 710 that surrounds or at least partially surrounds the body member 702. In this example device 102*a*/102*b*, the restraining member 710 may be spheroid, ellipsoid, cylindrical, or ring-shaped and configured such that it entirely covers and contains the opening 704 but leaves the body member 702 exposed at its top and/or bottom. This restraining element 710 may be made from a flexible or somewhat flexible polymeric material, e.g., a urethane material or other material flexible under application of force (e.g., in the substantially vertical direction and/or from landing a step and/or jump), but returns to or toward substantially its original shape and orientation when the force is sufficiently relaxed or relieved.

Restraining elements 710, in at least some examples of the invention, potentially may perform several functions. First, in at least some examples, the restraining element 710 may help prevent mud, dirt, or other debris or foreign material from entering the through hole 704 of the body member 702 and potentially weighing down or damaging the device 102*a*/102*b*. Additionally, the restraining element 710 may attenuate some of the compressive force to which the impact-attenuation device 102*a*/102*b* is exposed during use, which can help alleviate stress and/or strain on the impact-attenuation member 102*a*/102*b*. As another example, if desired, restraining element 710 may function as a stopper to prevent the impact-attenuation member 102*a*/102*b* from excessively deforming under the applied compressive force (which again can help alleviate stress and/or strain on the impact-attenuation member 102*a*/102*b*). As still another example, portions of the restraining element 710 side walls may exert an inward force on the impact-attenuation member 102*a*/102*b*, thereby helping the impact-attenuation member 102*a*/102*b* to return back to or toward its original orientation. Such spring back action, in at least some instances, can help improve the wearer's performance by providing a reflexive force to help recover from the exerted compressive force.

Of course, the restraining element 710, when present, can take on any size, configuration, arrangement, or orientation without departing from the invention. For example, the restraining element 710 need not completely cover the opening 704. Additionally or alternatively, the restraining element 710 may fit somewhat loosely around the outside of the body member 702 when no compressive force is applied to the device 102*a*/102*b* and then stop or help slow the flexure of the body member 702 and/or compression of impact-attenuation member 102*a*/102*b* when the force is applied (e.g., from landing a step or jump). As another alternative, the restraining element 710 may fit rather tightly around the outside of the impact-attenuation member 700 when no compressive force is applied to the member 102*a*/102*b* to provide a stiffer overall impact-attenuation member. Additionally, the restraining element 710 need not completely surround the impact-attenuation member 102*a*/102*b* (e.g., gaps, openings, or the like may be provided, the restraining element 710 may be C-shaped, etc., without departing from the invention). As still another potential alternative, the restraining element 710 may be made from more than one individual piece without departing from the invention (e.g., the restraining element 710 may constitute two or more C-shaped pieces that can clip around the impact-attenuation member 102*a*/102*b*, it may have upper and lower halves, etc.).

FIGS. 7A and 7B illustrate still additional potential features of impact-attenuation member structures 102*a*/102*b* that may be used in accordance with examples of this invention. As illustrated, in this example structure 102*a*/102*b*, the body member 702 includes one or more retaining elements 712 at its top and/or bottom surfaces that can be used to help mount the body member 702 to another device (such as base members 108 and/or 110 shown in FIG. 1). The retaining element(s) 712 may engage appropriately shaped openings, recesses, or grooves provided in another device (such as in base members 108 and/or 110) to help hold the body member 702 in place with respect to the other device. These retaining elements 712 also may be used to help securely hold the body members 702 at different rotational positions with respect to base members 108 and/or 110. Of course, any size, number, shape, and/or orientation of retaining elements 712 and corresponding openings, recesses, or grooves may be used without departing from this invention. As another alternative, if desired, the body member 702 may include the opening(s), groove(s), or recess(es) and the other device (e.g., base members 108 and/or 110) may include the projecting retaining elements 712. As still another alternative, if desired, each of the body member 702 and the device to which it is engaged may include a combination of openings and retaining structures 712 that fit into corresponding complementary structures 712 or openings provided in the mating device. Of course, additional ways of engaging the body member 702 with another device (such as a base member 108 and/or 110) may be used without departing from this invention, such as adhesives or cements; fusing techniques; mechanical connectors; and the like.

The difference in impact-attenuating characteristics (e.g., resistance to incident impact forces when landing a step or jump) between devices 102*a* and 102*b* may be provided by orienting device 102*b* somewhat different from devices 102*a* in an overall footwear structure (e.g., rotationally offset, as shown in FIGS. 2A through 2C). Additionally, if desired, additional differences in impact-attenuating characteristics between devices 102*a* and 102*b* may be provided in a wide variety of different manners without departing from this invention, optionally while still providing impact-attenuating members 102*a*/102*b* having the same general size, shape, appearance, etc. For example, at least some portions of the body member wall 706 in devices 102*b* may be made thinner, with a larger opening 704, and/or of a more flexible material, etc., as compared with the body member wall 706 in devices 102*a*. As another example or alternative, if desired, devices 102*a* may include a restraining member 710 whereas devices 102*b* do not (or devices 102*b* may include a weaker restraining member 710). The presence of, the absence of, and/or differences in reinforcing structures provided on or with the body member 702 (e.g., ribs in walls 706) also may produce differences in impact force attenuation for devices 102*a* and 102*b*.

Figure 8B:
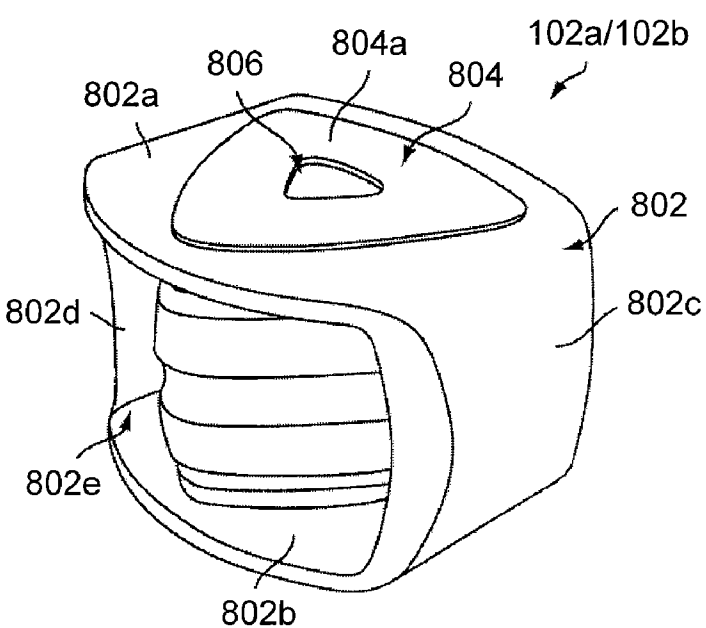
Figure 8A:
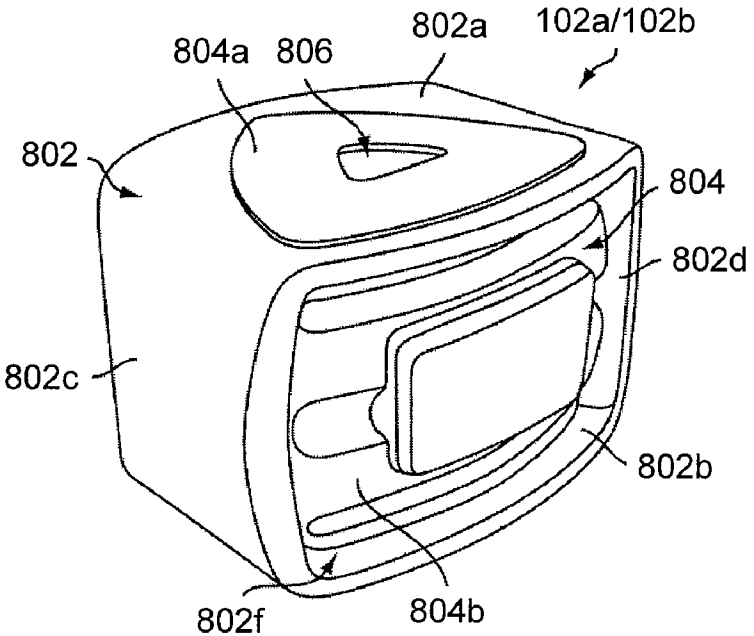

FIGS. 8A and 8B illustrate an example impact-attenuation member 102*a*/102*b* having a "box" or "caged" type column structure that may be used in accordance with at least some examples of this invention. As illustrated, the impact-attenuation member 102*a*/102*b* includes a shear resistant outer frame structure 802. While any desired frame structure 802 shape may be used without departing from this invention, in this illustrated example, the frame structure 802 is a substantially rectangular cubic or "box" shape (with gently curved, outwardly bowed side edges). The frame structure 802 includes a top wall 802*a*, a bottom wall 802*b*, two opposing side walls 802*c* and 802*d*, and two open, opposing sides 802*e* and 802*f*. The frame 802 defines a through hole or hollow structure between the walls 802*a* through 802*d*. Inside the frame structure 802, an impact-attenuating member 804 is provided. This impact-attenuating member 804 may be of any desired shape without departing from the invention. In this illustrated example, the impact-attenuating member 804 is substantially triangular cylinder shaped (with gently curved, outwardly bowed side edges).

The various parts of this example impact-attenuation member 102*a*/102*b* may be made of any desired materials without departing from this invention. For example, the impact-attenuating member 804 may be made of any desired impact-attenuating material, such as rubber (natural or synthetic), polymeric materials (e.g., polyurethane, ethylvinylacetate, phylon, phylite, foams, etc.), and the like, including impact-attenuating materials of the types used in known midsole structures, impact-attenuating columns, and/or footwear constructions, including those used in footwear commercially available from NIKE, Inc. of Beaverton, Oreg. under the SHOX brand trademark. The frame structure 802 may be made from a rigid but flexible or bendable material, such as rigid plastic materials like thermoplastic materials, thermosetting materials, polyurethanes, and other rigid polymeric materials, etc., including hard plastic or other materials conventionally used in sole structures, footwear, and/or other foot-receiving device structures. As a more specific example, the frame structure 802 may be made from a PEBAX® material (e.g., a polyether-block co-polyamide polymer commercially available from Atofina Corporation of Puteaux, France).

Various other example structural features of the impact-attenuation member 102*a*/102*b* may be seen in FIGS. 8A and 8B. For example, if desired, the impact-attenuating member 804 may be secured to the frame structure 802 (e.g., to the top wall 802*a* and/or the bottom wall 802*b*) in any desired manner, such as using mechanical connectors, adhesives, cements, friction fit, fusing techniques, restraining members, or the like. In this illustrated example, a top perimeter or surface portion 804*a* of the impact-attenuating member 804 fits into an opening or other retaining structure provided in the top wall 802*a*. This top perimeter or surface portion 804*a* may be fixed in the opening (or other structure), if desired, by adhesives or cements, mechanical connectors, friction fit, fusing techniques, etc. Also, if desired, a similar (or structurally different) securing system may be provided at the bottom of the impact-attenuating member 804 and/or with the bottom wall 802*b* of the frame structure 802. As additional examples, if desired, the opening may be omitted, and the impact-attenuating member 104 may be fixed to the inside surface of the top wall 802*a* and/or bottom wall 802*b* (e.g., by adhesives, etc.), it may fit into grooves, recesses, or other structures provided inside the frame structure 802, etc. If desired, a restraining member (like that described in more detail in conjunction with FIG. 7B) may be used to at least partially surround or enclose the impact-attenuation member 102*a*/102*b* and/or to hold the impact-attenuating element 804 in place.

While the impact-attenuation member 102*a*/102*b* may be mounted in an article of footwear or other foot-receiving device structure in any desired manner without departing from this invention, in this illustrated example structure, the impact-attenuation member 102*a* may be mounted such that the side walls 802*c* and 802*d* extend substantially in the lateral, side-to-side direction of the article of footwear (e.g., such that a horizontal line parallel to and located on the surface of the wall member 802*c* and/or 802*d* runs generally in the side-to-side direction of the article of footwear to which it is mounted and/or substantially parallel to an expected direction of lateral or shear force to which the footwear may be exposed, e.g., during a cutting action, during a rapid direction change action, during a quick stopping action, etc.). In other words, in this illustrated example structure, the triangular point of the impact-attenuating member 804 that points out the open side 802*e* may be arranged to point toward the lateral or medial side of the shoe structure (and optionally toward the interior of the shoe, e.g., of the heel area), such that the broad side 804*b* of the impact-attenuating member 804 faces outward. In the rear, lateral heel position 202*d*, the impact-attenuating member 102*b* may be mounted in a rotated manner with respect to the orientation described above (or otherwise changed in orientation), e.g., with the triangular point of impact-attenuating member 804 pointing more in the longitudinal direction or even outward from the shoe.

The above described structure and arrangements of the impact-attenuation members 102*a*/102*b* in a footwear structure can provide various advantageous features. For example, in the structure and arrangement described above, the open sides 802*e* and 802*f* of the frame structure 802 will allow the top wall 802*a* and bottom wall 802*b* of the frame structure 802 to deflect and move toward one another under a compressive force (e.g., when a wearer lands a step or jump). The rigidity of the frame structure 802 and the density of the impact-attenuating material 804 may be selected such that the overall structure provides a controlled, desired degree of compression in the substantially vertical direction (and/or provide differences in force resistance for devices 102*a* as compared to 102*b*). If desired, the impact-attenuating member 804 may include a through-hole, blind hole, opening, or hollow structure 806, e.g., to allow gas to escape from the material and compression when compressive forces are applied to it. Gaps provided between the impact-attenuating member 804 and the side walls 802*c* and 802*d*, if any, also may help keep the frame structure 802 out of the impact-attenuating member 804's way during its compression, such that its compression is not substantially impeded or restricted. Also, if desired, the various features and characteristics of the frame structure 802 (e.g., plastic rigidity, thickness, length, width, height, wall curvature, wall sizes, etc.) may be selected to control its resistance to deflection and compression in the vertical direction (e.g., if desired, to provide minimal or limited compression resistance in the vertical direction, and to allow the impact-attenuating member 804 to perform the majority of the impact-attenuating functions).

Despite its readily controllable compressibility and its ability to compress in the vertical direction (e.g., due, at least in part, to the open ends 802*e* and 802*f* of frame structure 802), this overall structure 102*a* is laterally stable and resistant to shear forces and to collapse, toppling, or other failure from shear forces, e.g., in the horizontal, side-to-side direction (in the lateral-to-medial side direction), due, at least in part, to the presence of the side walls 802*c* and 802*d* and their arrangement in a direction substantially parallel to the shear force incident direction for impact-attenuating members 102*a*. More specifically, the side walls 802*c* and 802*d* of impact-attenuating member 102*a* provide strong structures that resist collapse or movement when forces in opposing horizontal directions are applied at the top and bottom of the side wall structures 802*c* and 802*d* in a lateral-to-medial side direction, e.g., when a wearer stops quickly, makes a cutting action, changes directions, etc.

In addition to differences in the orientation of members 102*a* and 102*b* in a footwear structure (e.g., rotational offset as illustrated in FIGS. 2A through 2C), additional differences in resistance to impact force between impact-attenuating members 102*b* and members 102*a* may be accomplished in a variety of ways. For example, various features and characteristics of the frame structure 802 (e.g., plastic rigidity, thickness, length, width, height, wall curvature, wall sizes, etc.) for members 102*b* may be selected to provide less resistance to impact force (e.g., by providing thinner walls, different materials, more curvature, etc.) as compared to the respective properties of the frame structure 802 for members 102*a*. As additional examples, the various features and characteristics of the impact-attenuating member 804 in members 102*b* may be selected to provide less resistance to impact force (e.g., by providing a more compressible structure 804, by providing a lower density structure 804, by providing a higher percentage of voids, by providing a larger through hole 806, etc.), as compared to the similar features and characteristics of impact-attenuating member 804 in members 102*a*.

Figure 9A:
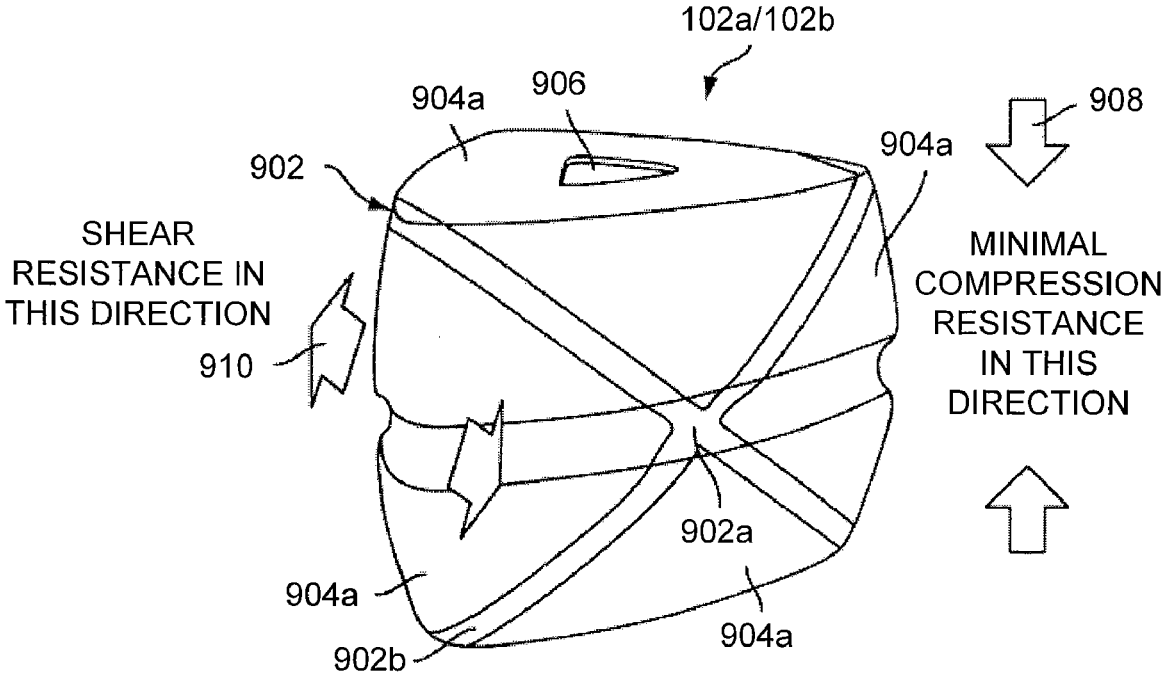
Figure 9B:
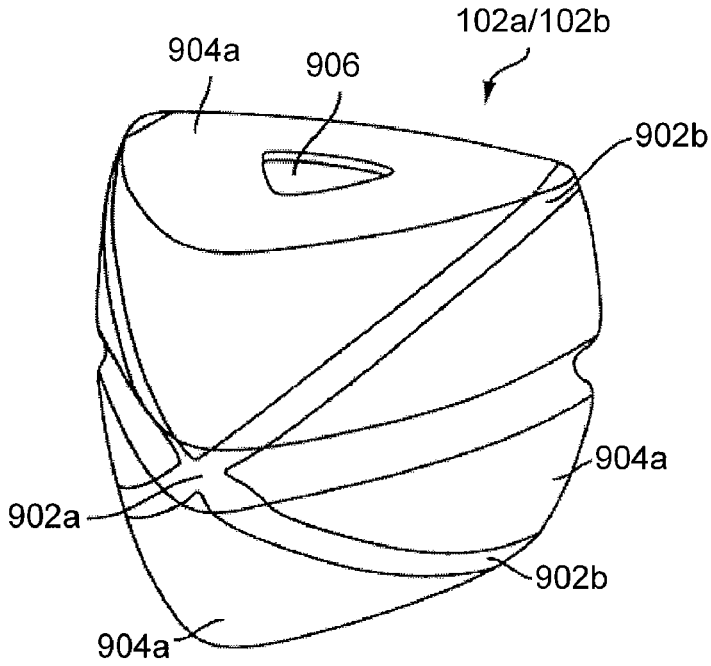

FIGS. 9A and 9B illustrate another example impact-attenuation member 102*a*/102*b* that may be used in footwear structures in accordance with this invention. This example impact-attenuation member 102*a*/102*b* includes a shear resistant member 902 and an impact-attenuating member 904, e.g., optionally made from the materials used for shear resistant members 802 and impact-attenuating members 804, respectively, described above. In this illustrated example impact-attenuation member structure 102*a*/102*b*, the shear resistant member 902 includes a central region or "hub" 902*a* with plural vanes 902*b* extending from it (e.g., to provide an overall three-dimensional "X" shaped shear resistant member 902). The impact-attenuating member 904 of this example structure 102*a*/102*b* constitutes a plurality of independent sections 904*a* arranged between the vanes 902*b* of the shear resistant member 902.

While the illustrated impact-attenuating member 904 constitutes plural independent and separate sections 904*a*, this is not a requirement. For example, if desired, some or all of the sections 904*a* may be joined together and constitute a single piece. Additionally, while the shear resistant member 902 is shown as a single piece in FIGS. 9A and 9B, it may be made of multiple pieces without departing from this invention (e.g., a hub element with individual vane members attached thereto). Of course, the impact-attenuating member sections 904*a* and the shear resistant member 902 of this structure 102*a*/102*b* may be held together in any desired manner without departing from this invention. For example, cements, adhesives, fusing techniques, friction fits, retaining structures, and/or mechanical connectors may be used to hold the various elements in place with respect to one another. As another example, if desired (and as illustrated in the example structure of FIG. 7B), a restraining element (e.g., made of plastic material) may at least partially fit around and contain the various parts of the impact-attenuation member 102*a*/102*b*.

If desired, as illustrated in FIGS. 9A and 9B, at least some of the impact-attenuating member sections 904*a* may define a central opening or through hole 906, e.g., to allow a place for compression, to allow a place for gas escape from the interior of the sections 904*a* during compression, etc. Also, if desired, a central region of the shear resistant member 902 (e.g., the portion of the hub 902*a* enclosed within the impact-attenuating sections 904*a*) also may define an open area, to better allow or control deformation of the shear resistant member 902 under impact forces 908, to allow impact-attenuating member 904 deformation and compression, to allow gas escape, etc.

When mounted in an article of footwear or other foot-receiving device product, impact-attenuation members 102*a* of the types illustrated in FIGS. 9A and 9B may be arranged such that the vertical or landing direction force 908 extends between arms of the "X" of the shear resistant member 902 and such that the hub 902*a* and the major surfaces of the vanes 902*b* extend substantially parallel to a side-to-side direction in the footwear structure and in a direction of expected lateral or shear forces 910 when a wearer makes stopping, cutting, or direction changing actions. Impact-attenuation members 102*b* may be rotated somewhat (or otherwise changed in orientation) with respect to members 102*a*, as illustrated in FIGS. 2A to 2C, to thereby alter their impact-attenuation characteristics. The "stiffness" of the overall impact-attenuation member structure 102*a*/102*b* may be further controlled (and may help make the stiffness of structures 102*a* different from structures 102*b*), for example, by providing and/or controlling: the size of any openings in the shear resistant member 902; the thickness, angle, and/or positioning of the vanes 902*b*; the dimensions of the central region 902*a* at which the vanes 902*b* are joined; the number of vanes 902*b*; the material of the shear resistant member 904; the density of structures 904*a*; the percentage of voids in structures 904*a*; the size of the opening 906; etc. If desired, the shear resistant member 902 may be selected and arranged so as to provide minimal or a desired degree of impact-attenuation against impact forces 908, e.g., in a vertical direction or in an impact force incident direction when landing a step or jump, and such that the impact-attenuating members 904*a* provide the majority of the impact-attenuating characteristics.

Of course, any number and/or arrangement of vanes 902*b* may be used without departing from the invention. As some more specific examples, if desired, two vanes 902*b* may extend from a central region 902*a* with the central region 902*a* arranged toward the bottom and/or top of the overall impact-attenuation member structure, e.g., to provide an U- or overall V-shaped and/or inverted U- or V-shaped shear resistant member structure.

Figure 10A:
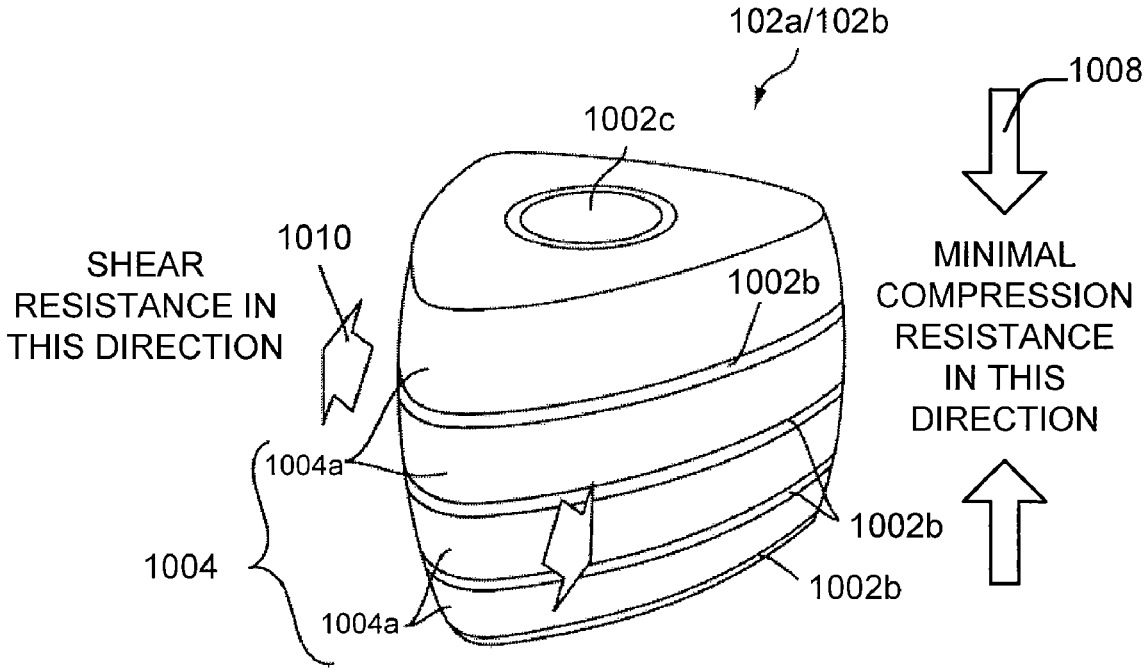
Figure 10B:
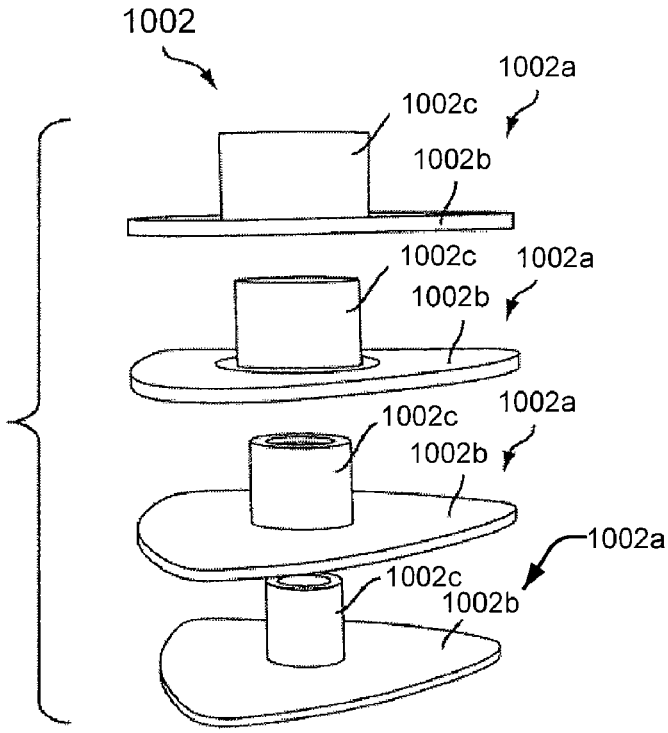

Another example impact-attenuation member structure 102*a*/102*b* that may be used in examples of this invention is illustrated in FIGS. 10A and 10B. Again, this example structure 102*a*/102*b* includes a shear resistant member 1002 and an impact-attenuating member 1004. In this example structure 102*a*/102*b*, the shear resistant member 1002 includes a plurality of independent portions 1002*a*, and each portion 1002*a* includes a base member 1002*b* and an extending member 1002*c*. Independent sections 1004*a* of the impact-attenuating member 1004 are arranged between the portions 1002*a* of the shear resistant member 1002. The shear resistant member 1002 and the impact-attenuating member 1004 may be made, for example, from the materials used for shear resistant members and impact-attenuating members, respectively, described above.

The extending members 1002*c* of the shear resistant member 1002 may be sized such that the exterior diameter of one extending member 1002*c* is somewhat smaller than an opening in the base member 1002*b* (and an open interior diameter of the extending member 1002*c*) immediately adjacent to it in one direction. In this manner, when compressed against a substantially vertical or other impact force 1008 (e.g., when landing a jump or step), the extending members 1002*c* will extend through and slide in the openings in the adjacent neighboring base member 1002*b* and optionally inside its extending member 1002*c*, e.g., in a telescoping manner. If desired, in its uncompressed state, the extending members 1002*c* may extend at least somewhat within and/or be retained within its adjacent extending member 1002*c* in a telescoping manner, which helps maintain the desired telescoping structural arrangement at all times, whether or not compressing forces 1008 act on the overall structure 102*a*/102*b*. A tight fit in this telescoping manner also can assist in providing lateral stability and resistance to shear or lateral forces 1010, as the extending portions 1002*c* will tend to contact one another and provide resistance under lateral or shear force 1010. If necessary or desired, lubricating material may be provided to enable easy sliding movement of one extending member 1002*c* with respect to others.

While FIGS. 10A and 10B illustrate the shear resistant member 1002 and the impact-attenuating member 1004 each as a plurality of independent portions 1002*a* and sections 1004*a*, this is not a requirement. For example, if desired, some or all of the portions 1002*a* and/or sections 1004*a* may be joined together and/or constitute a single piece. Of course, the impact-attenuating member sections 1004*a* and the shear resistant member portions 1002*a* of this structure 102*a*/102*b* may be held together in any desired manner without departing from this invention. For example, cements, adhesives, fusing techniques, friction fits, retaining structures, and/or mechanical connectors may be used to hold the various elements together and in place with respect to one another. As another example, if desired (and as illustrated in the example structure of FIG. 7B), a restraining element (e.g., made of plastic material) may at least partially fit around and contain the various parts of the impact-attenuation member 102*a*/102*b* of FIGS. 10A and 10B. The elements of the impact-attenuation member 102*a*/102*b* also may be held together by the presence of structural elements in an overall structure (e.g., footwear or other foot-receiving device structure) in which it is mounted.

When mounted in an article of footwear or other foot-receiving device, impact-attenuation members 102*a*/102*b* of the types illustrated in FIGS. 10A and 10B may be arranged such that the vertical direction and/or direction of expected impact force 1008 extends substantially in the direction of the extending members 1002*c* and such that the major surfaces of the base portions 1002*b* of the shear resistant members 1002 extend substantially parallel to a side-to-side direction in the footwear structure and/or in a direction of expected lateral or shear forces 1010 when making stopping, cutting, or direction changing actions. The "stiffness" or resistance to impact forces of the overall impact-attenuation member structure 102*a*/102*b* may be controlled, for example, by orienting impact-attenuating members 102*b* in a rotationally offset manner (or otherwise in a different orientation) as compared to members 102*a* (e.g., as shown in FIGS. 2A through 2C).

Additional differences in impact-attenuation characteristics may be provided, if desired, between members 102*a* and 102*b* by controlling: the thickness, angle, and/or positioning of the shear resistant portions 1002*a*; the number of shear resistant portions 1002*a*; the materials of the shear resistant portions 1002*a* and/or impact-attenuating sections 1004*a*; the density or void percentage of the impact-attenuating sections 1004*a*; the size of the openings 1002*c*; etc. If desired, the shear resistant member 1002 may be structured so as to provide minimal or a desired degree of impact-attenuation against impact forces 1008, e.g., in a vertical direction or in an incident direction when landing a step or jump, such that the impact-attenuating sections 1004*a* provide the majority of the impact-attenuation function.

Figure 11:
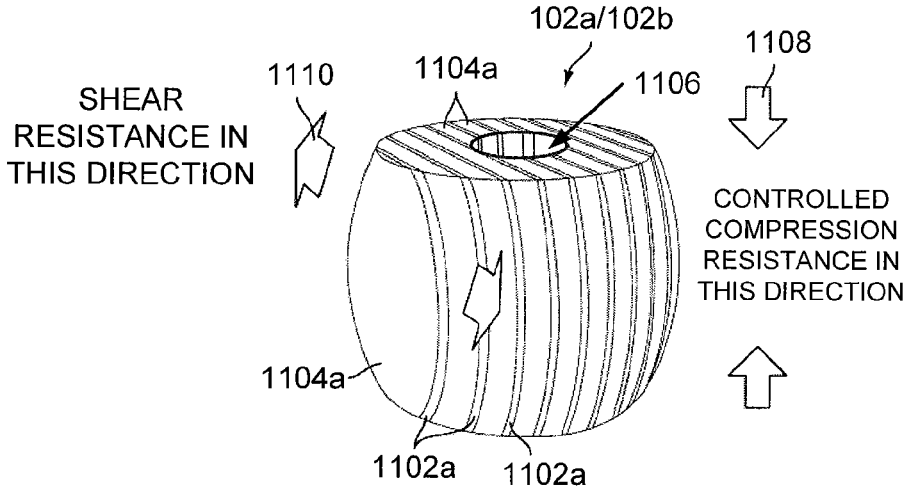

FIG. 11 illustrates another example impact-attenuation member 102*a*/102*b* that may be used in accordance with examples of this invention. Like various example structures described above, this impact-attenuation member 102*a*/102*b* includes shear resistant members and impact-attenuating members, e.g., optionally made from the materials used for the shear resistant members and impact-attenuating members described above. More specifically, in this example impact-attenuation member structure 102*a*/102*b*, the shear resistant member constitutes a plurality of wall slats 1102*a*, e.g., arranged in parallel and vertically or in the direction of expected incident force 1108, e.g., when landing a step or jump. Similarly, the impact-attenuating member constitutes a plurality of slat members 1104*a*, e.g., arranged in parallel and vertically or in the direction of the expected incident force 1108, e.g., when landing a step or jump.

While FIG. 11 illustrates the shear resistant members and the impact-attenuating members as a plurality of independent and distinct slat walls 1102*a* or slat members 1104*a*, respectively, this is not a requirement. For example, if desired, at least some of the slat walls 1102*a* could emanate from a common shear resistant member base provided, for example, at the top and/or bottom surfaces of the overall impact-attenuation member structure 102*a*/102*b*. Additionally or alternatively, if desired, at least some of the slat members 1104*a* could emanate from a common impact-attenuating member base provided, for example, at the top and/or bottom surfaces of the overall impact-attenuation member structure 102*a*/102*b*. As still another example, if desired, the bases for the shear resistant members and/or the impact-attenuating members, when present, may be provided at locations other than the top and/or bottom of the overall impact-attenuation member structure 102*a*/102*b* (such as from a base member engaged with the impact-attenuating member side, from a base member extending through a central portion of the column structure, etc.). Also, the bases for the shear resistant members and/or the impact-attenuating members, when present, may provide additional shear resistance and/or impact-attenuation characteristics.

The impact-attenuating members 1104*a* and the shear resistant members 1102*a* of this structure 102*a*/102*b* may be held together in any desired manner without departing from this invention. For example, cements, adhesives, fusing techniques, friction fits, retaining structures, and/or mechanical connectors may be used to hold the various elements in place with respect to one another. As another example, if desired (and as illustrated in the example structure of FIG. 7B), a restraining element (e.g., made of plastic material) may at least partially fit around and contain the slat walls 1102*a* and slat members 1104*a*.

If desired, as illustrated in FIG. 11, the impact-attenuating slat members 1104*a* (and/or the slat walls 1102*a*) may define a central opening 1106, e.g., to allow a place for compression, to allow a place for gas escape from the interior of the slat members 1104*a* during compression, to allow room for slat wall 1102*a* movement or deflection during compression, etc.

When mounted in an article of footwear or other foot-receiving device product, impact-attenuation members 102*a* of the types illustrated in FIG. 11 may be arranged such that the slat wall members 1102*a* extend substantially in a direction from the top to the bottom in the overall footwear structure (e.g., such that the major surfaces of the slat walls 1102*a* run substantially parallel to the vertical direction and/or a direction of expected impact forces 1108 and substantially parallel to a side-to-side direction in the footwear structure and/or a direction of expected lateral or shear forces 1110 when a wearer makes at least some stopping, cutting, or direction changing actions). Impact-attenuating members 102*b* may be rotated somewhat as compared to the arrangement of members 102*a* (or otherwise changed in orientation), as illustrated in FIGS. 2A through 2C, to thereby alter the impact-attenuation characteristics (e.g., soften) of members 102*b* as compared to members 102*a*. Because the slat wall members 1102*a* are oriented substantially parallel to the expected impact force direction 1108 in this illustrated example structure 102*a*/102*b*, these impact-attenuation members 102*a*/102*b* may be expected to be somewhat "stiffer" feeling than some of the other structures described above (because no "collapsing" structure is described above). Such a "stiffer" feeling may be desirable for at least some wearers, in at least some situations and/or uses (e.g., for use in some sporting applications, such as soccer, football, baseball, etc.). Nonetheless, the thickness, overall number, spacing, opening 1106 size and/or other features of the slat walls 1102*a* and/or slat members 1104*a* may be controlled and/or selected to provide a desired degree of impact-attenuation with respect to impact forces (and/or to provide additional differences in impact force resistance for devices 102*a* as compared to devices 102*b*).

Of course, other ways for making impact-attenuation member structures 102*a*/102*b* of the types illustrated in FIG. 11 less "stiff" are possible without departing from this invention. For example, if desired, the slat walls 1102*a* could be provided with "zigzags," "fail" or "bend" lines, or other pre-bent structures, e.g., as illustrated and/or described below with respect to FIGS. 12A and 12B. As another example, if desired, the slat walls 1102*a* could be curved somewhat, to bias the walls to bend in a predetermined manner and/or direction. As still another example, the slat walls 1102*a* could be arranged at an angle with respect to the vertical (or expected direction of impact forces 1108), to thereby allow more of a "collapsing" or softer feel. Also, as yet another alternative, the slat walls 1102*a* could include portions that slide or otherwise move with respect to another portion thereof (akin to a shock-absorber arrangement), to thereby allow more of a "collapsing" or softer feel.

Figure 12A:
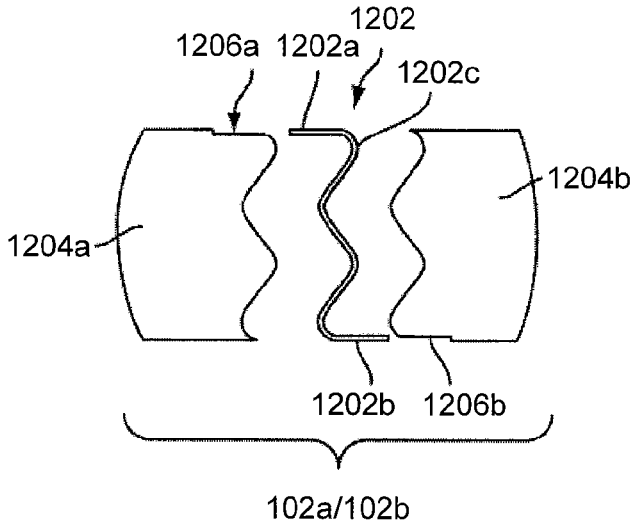
Figure 12B:
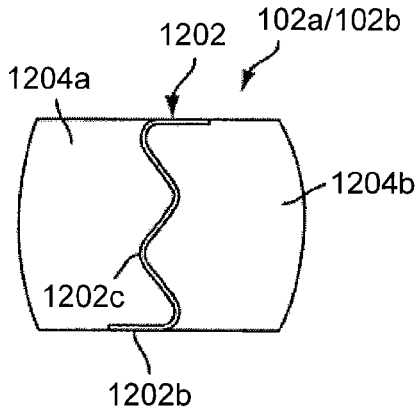

FIGS. 12A and 12B illustrate another example impact-attenuation member 102*a*/102*b* that may be used in accordance with some examples of this invention. In this example structure 102*a*/102*b*, a shear resistant wall member 1202 is provided that is at least partially embedded in or surrounded by one or more impact-attenuating members (a single wall member 1202 centrally located between two independent impact-attenuating member portions 1204*a* and 1204*b* is shown in the illustrated example of FIGS. 12A and 12B). If desired, the wall member 1202 may include an expanded top surface 1202*a* and/or an expanded bottom surface 1202*b*, and optionally, these expanded surfaces 1202*a* and/or 1202*b* may extend in one (or optionally more) directions from the vertical wall portion 1202*c* and along the top and bottom, respectively, of the overall column structure 102*a*/102*b*. These expanded surfaces 1202*a* and 1202*b* may fit into (and optionally may be cemented to) recessed areas 1206*a* and 1206*b* provided in the top and/or bottom of the impact-attenuating member portions 1204*a* and 1204*b*, so as to provide an overall relatively smooth, flush surface when fit together and to further enhance shear resistance. These top and bottom surfaces 1202*a* and 1202*b*, respectively, may cover as much of the top and bottom portions of the columnar impact-attenuation member structure 102*a*/102*b* as desired, and optionally, they may include one or more openings defined therein. This overall example impact-attenuation member 102*a*/102*b* may be fit and held together in any desired manner without departing from this invention, including through the use of cements, adhesives, mechanical connectors, fusing techniques, restraining members, friction fits, retaining structures, and the like. Of course, if desired, multiple shear resistant wall members (e.g., like wall member 1202) may be provided in the overall structure 102*a*/102*b* without departing from this invention.

The shear resistant wall member 1202 may be made from any desired materials without departing from this invention, including the various materials described above, e.g., for use with the frame structure 802. Likewise, the impact-attenuating member portions 1204*a* and 1204*b* may be made from any desired materials without departing from the invention, including the same or different materials, and including the various materials described above for impact-attenuating material 804. If desired, at least a portion of one of the impact-attenuating member portions 1204*a* and/or 1204*b* may be at least partially hollowed out and/or contain a through hole, e.g., to allow room for compression, gas release, and/or wall member 1202 deflection or movement during compression of the columnar structure 102*a*/102*b*.

The above described structure and arrangement of the impact-attenuation member 102*a*/102*b* can provide various advantageous features. For example, in the structure and arrangement described above, the zigzag structure of the wall member 1202 will allow the top surface 1202*a* and bottom surface 1202*b* of the wall member 1202 to relatively move toward one another under a compressive force (e.g., when a wearer lands a step or jump) in a uniform and repeatable manner. The rigidity of the wall member 1202 and/or the density of the impact-attenuating member portions 1204*a* and 1204*b* may be selected and/or controlled such that the overall structure 102*a*/102*b* provides a controlled, desired degree of compression in the substantially vertical or landing direction (and such that devices 102*a* can be made to have different force resistance as compared to devices 102*b*). The relative orientations of the members 102*a* and 102*b* in a shoe structure (e.g., rotationally or otherwise offset as compared to one another) also may be used to provide differences in the impact-attenuation characteristics. Because of its zigzag structure, the wall member 1202 can be made to relatively freely collapse under compressive force, but it also can be made so as to substantially return to or toward its original shape and orientation once the force is released or relaxed. Also, if desired, the various features and characteristics of the wall member 1202 (e.g., plastic rigidity, thickness, length, width, height, numbers of zigzags, the presence of openings, etc.) may be selected to control its resistance to deformation and compression in the vertical or landing direction (e.g., to provide minimal compression resistance in the vertical or landing direction, if desired, and to allow the impact-attenuating member portions 1204*a* and 1204*b* to perform the majority or substantially all of the impact-attenuating functions).

Despite its readily controllable compressibility and its ability to readily compress in the vertical or landing direction (e.g., due, at least in part, to the zigzag structure of wall member 1202), this overall structure 102*a*/102*b* may be resistant to shear forces and to collapse, toppling, or other failure from shear forces, e.g., in the horizontal, side-to-side direction (in the lateral-to-medial side direction or vice versa) due, at least in part, to the presence of the major wall portion 1202*c* and its arrangement in a direction substantially parallel to the shear force incident direction, at least for members 102*a*. More specifically, the major wall portion 1202*c* in members 102*a* provides a strong structure that resists collapse, deformation, or movement when forces in different directions are applied at its top and bottom, e.g., when a wearer stops quickly, makes a cutting action, changes directions, etc.

Of course, other ways of providing a "collapsible" wall member are possible without departing from this invention. For example, if desired, the shear resistant wall member could be curved rather than zigzag structured. As another example, if desired, pre-bent lines or "fail" lines could be provided in a wall member structure to better allow the wall member to collapse in the vertical direction. As still another example, if desired, a multi-part wall member 1202 may be provided, optionally spring biased to the uncompressed orientation, in which one portion of the wall member slides, rotates, or otherwise moves with respect to another part of the wall member to thereby provide a collapsing structure. Also, if desired, a single impact-attenuation member 102*a*/102*b* may include multiple shear resistant wall members, e.g., zigzag or otherwise structured.

Figure 13A:
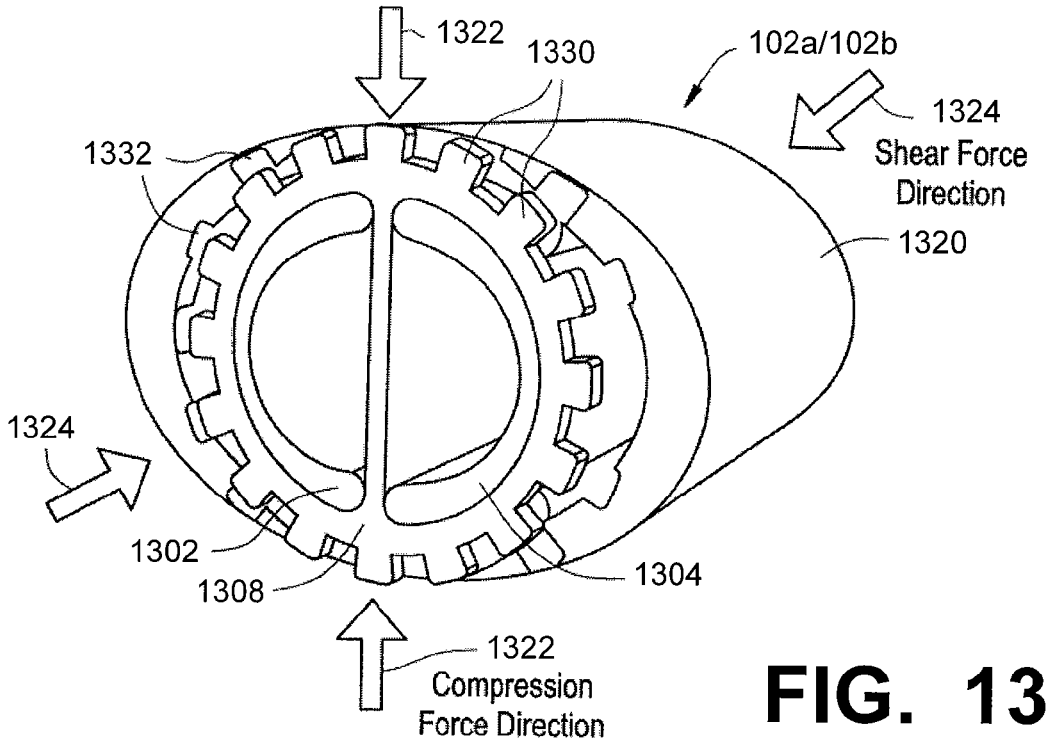
Figure 13B:
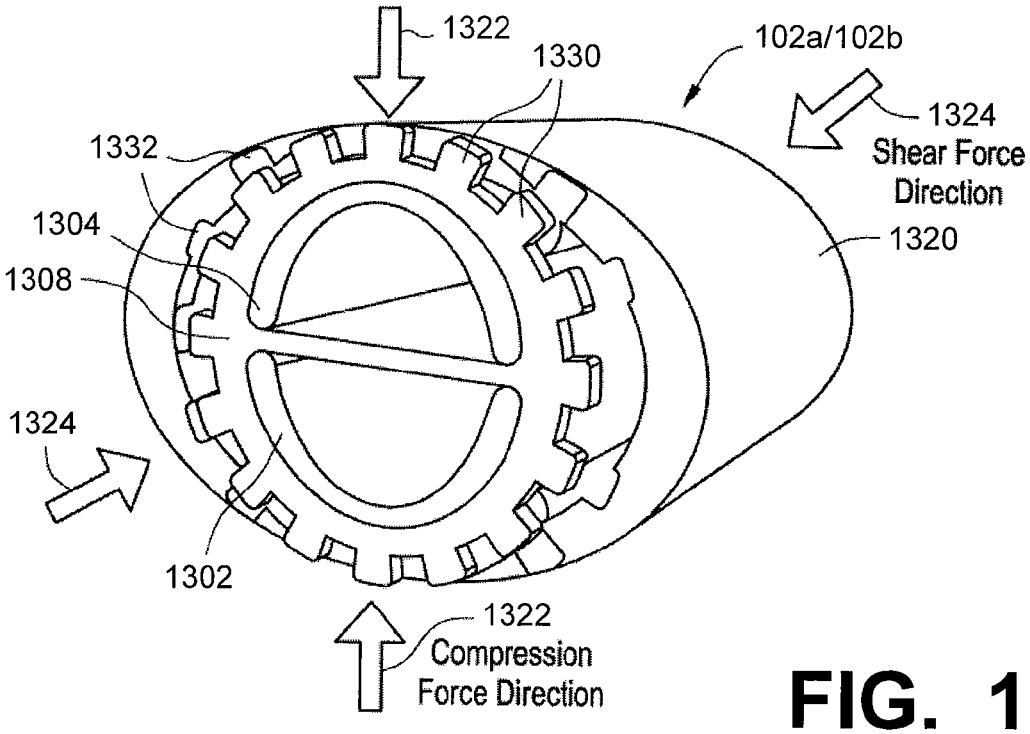

FIGS. 13A and 13B illustrate an example structure wherein other orientation changes may be used to provide differences in impact-attenuation characteristics at the rear, lateral, heel, landing, or other position. The example impact-attenuating member of FIGS. 13A and 13B may be releasably engaged with one or more base members 1320, and the impact-attenuation member 102*a*/102*b* may be sized, shaped, and/or otherwise configured such that it can be removed from and/or reoriented with respect to the base member(s) 1320 in a plurality of different ways. In the example orientation illustrated in FIG. 13A, the impact-attenuation member 102*b* would be relatively "soft" with respect to forces 1322 acting in a generally vertical direction (e.g., forces experienced when a wearer lands a step or jump, etc.). The softer "feel" may be due, at least in part, to the vertical arrangement of a spring member 1308 in the central region between the body portions 1302 and 1304 (e.g., the impact forces 1322 need not stretch the spring member 1308 at its central location, and the body members 1302 and 1304 are arranged to bend relatively easily). When removed and reoriented with respect to the base member(s) 1320 in the manner illustrated in FIG. 13B, on the other hand, the impact-attenuation member 102*a* would be relatively "firm" or "hard" with respect to forces 1322 acting in a generally vertical direction (e.g., forces experienced when a wearer lands a step or jump, etc.), e.g., due, at least in part, to the need to stretch the spring member 1308 across the central open area. Wearers or other may be allowed to freely reorient or replace the impact-attenuation member 102*a*/102*b*, e.g., based on an expected use, based on personal characteristics or preferences, based on location in the footwear structure, etc.

Of course, any manner of engaging the impact-attenuation member 102*a*/102*b* with the base member(s) 1320 is possible without departing from the invention. For example, the exterior surface of the spring member 1308 and/or the body portions 1302 and/or 1304 may include ribs, ridges, and/or other structures that engage with grooves, openings, and/or recesses formed in the base member(s) 1320 interior surface (or vice versa). In this illustrated example structure 102*a*/102*b*, ridges 1330 provided around the exterior surface of the spring member 1308 engage grooves 1332 provided in the interior surface of the base member 1320. Because ridges 1330 are provided at spaced locations around the entire exterior of the circular spring member structure 1308, the impact-attenuation member 102*a*/102*b* may be engaged with and oriented with respect to the base member 1320 in many different orientations, to thereby provide a variety of different potential impact-attenuation characteristics or "feels." As additional and/or alternative examples, if desired, mechanical connectors, retaining elements, adhesives, a tight friction fit, and the like may be used to hold the impact-attenuation member(s) 102*a*/102*b* in place with respect to the base member(s) 1320. Also, any number of base members 1320 and impact-attenuation members 102*a*/102*b*, in any desired combinations of impact-attenuation members 102*a*/102*b* with respect to base members 1320, may be used in a footwear or other structure without departing from this invention (e.g., one base member 1320 or base member set may engage any number of impact-attenuation members 102*a*/102*b*, and one impact-attenuation member 102*a*/102*b* may engage one or multiple base members 1320 without departing from this invention).

The structure, arrangement, and/or materials of the body portions 1302 and 1304 may provide stability against lateral or shear forces 1324, while the overall device 102*a*/102*b* provides adjustable and/or customizable impact-attenuation properties as described above. This shear stability may be provided, for example, by arranging the impact-attenuation member 102*a*/102*b* such that the body portions 1302 and 1304 extend in a direction substantially parallel to the expected direction of the shear or lateral force 1324, as shown in FIGS. 13A and 13B. The base member(s) 1320, when present, also may be used to provide lateral stability.

Figure 14:
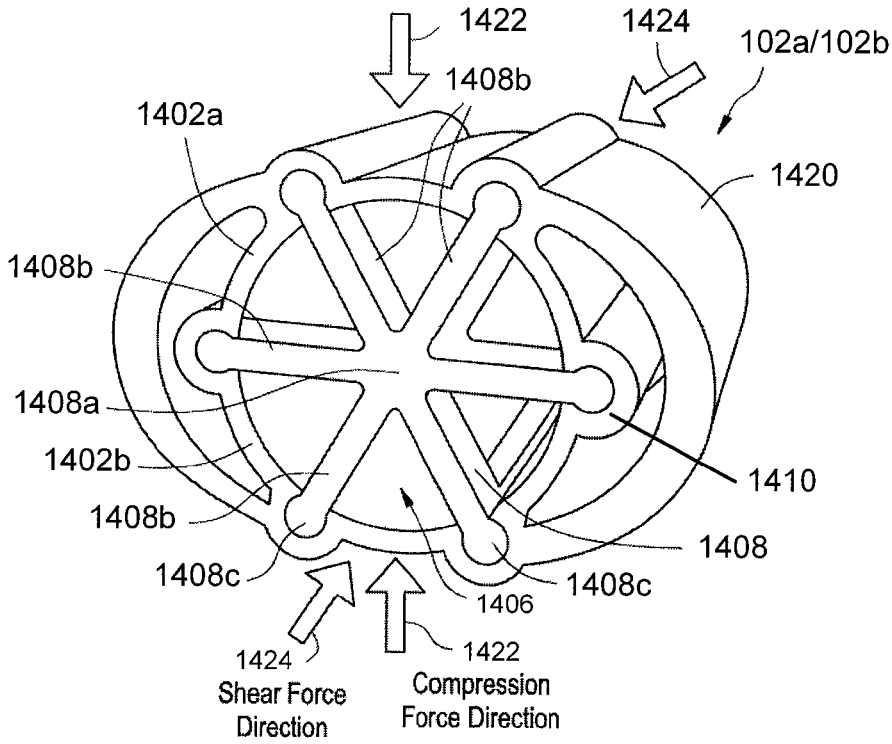

FIG. 14 illustrates another example impact-attenuating member structure 102*a*/102*b* that may be used in accordance with some examples of this invention. In this illustrated example structure 102*a*/102*b*, while not a requirement, the body member portions 1402*a* and 1402*b* are integrally formed with one another as a unitary, one piece construction, and these body portions 1402*a* and 1402*b* form an open space 1406 therebetween. Additionally, in this illustrated example structure 102*a*/102*b*, again while not a requirement, the body portions 1402*a* and 1402*b* are integrally formed with a base member 1420, which may be attached to or integrally formed as part of another overall structure, such as an article of footwear or other foot-receiving device product structure. The body portions 1402*a* and 1402*b*, as well as the base member 1420, may be made from any desired materials having any desired characteristics without departing from this invention, including, for example, the various rigid materials and characteristics described above for use as other body members and/or base members.

In the example structure 102*a*/102*b* of FIG. 14, the spring member 1408 includes a central hub region 1408*a* with multiple arms 1408*b* extending from the hub region 1408*a* toward and to the body portions 1402*a* and 1402*b*. While the arms 1408*b* may engage the body portion(s) in any desired manner without departing from this invention, in this illustrated example structure 102*a*/102*b*, the free ends of the arms 1408*b* included enlarged or bulbed portions 1408*c* that engage chambers 1410 defined by or provided in or on the body portion(s) 1402*a* and/or 1402*b*. The spring member 1408, including the central hub region 1408*a*, the arms 1408*b*, and the enlarged portions 1408*c*, may be made as a unitary, one piece construction or from any desired number of individual parts or pieces without departing from this invention. The overall spring member 1408 also may be made from any desired material(s) having any desired characteristics, without departing from this invention, including, for examples, the various materials and characteristics described above for use in connection with spring members described above.

In the illustrated example structure 102*a*/102*b*, six arm members 1408*b* extend from the central hub region 1408*a* at an evenly spaced distribution around the hub region 1408*a*. Of course, any number of arms 1408*b*, in any desired arrangement or orientation with respect to the hub region 1408*a*, may be provided without departing from this invention.

Also, in this illustrated example structure 102*a*/102*b*, the spring member 1408 has an axial length such that one set of arm members extends from the central hub region 1408*a* at one side of the structure 102*a*/102*b* and a second set of arm members 1408*b* extends from the central hub region 1408*a* axially spaced and at the opposite side of the structure 102*a*/102*b*. While the body portions 1402*a* and 1402*b* extend the entire axial length of the member 102*a*/102*b* in this illustrated structure, if desired, separate body portions also may be provided for each separate, axially spaced set of arm members 1408*b*. Also, the various axially spaced sets of arm members 1408*b* and/or body portions 1402*a* and 1402*b* may be constructed the same or different without departing from the invention, e.g., they may have the same or different overall structures, configurations, numbers, orientations, materials, and the like without departing from this invention. Alternatively, if desired, the arm members 1408*b* also may extend the entire axial length of the impact-attenuating member 102*a*/102*b*. As still additional examples, if desired, plural sets of arm members 1408*b* may extend from a single axial hub 1408*a* at different axial locations along the axial hub 1408*a* length (e.g., one set of arm members 1408*b* near one end of the hub 1408*a* near one edge of the member 102*a*/102*b*, one set of arm members 1408*b* near the other end of the hub 1408*a* near the other edge of the member 102*a*/102*b*, one set of arm members 1408*b* at a central location along the hub 1408*a* near the center of member 102*a*/102*b*, etc.). As yet another example, separate hubs 1408*a* and arm members 1408*b* may be provided at various locations along the depth of member 102*a*/102*b*. Any desired arrangement and/or numbers of hubs 1408*a*, sets of arm members 1408*b*, etc. may be used without departing from this invention.

As noted above, the body members 1402*a* and 1402*b* may be contained within, attached to, and/or integrally formed with a base member 1420. The base member 1420 with the body portions 1402*a* and 1402*b* and the spring member 1408 may form a separate impact-attenuation member structure 102*a*/102*b* (as shown in FIG. 14). Alternatively, if desired, the base member 1420 (optionally along with at least the body portions 1402*a* and 1402*b*) may form a portion of another device's structure, such as a heel cage or heel unit structure, a sole member or other foot-supporting member structure, an overall footwear or other foot-receiving device structure, etc. If desired, in order to provide differences in the impact-attenuation characteristics for members 102*a* as compared to members 102*b*, the members 102*a*/102*b* may be rotationally offset in the footwear structure from one another (or otherwise changed in orientation), e.g., in the manner illustrated in FIGS. 2A through 2C.

In use, if desired, the spring member 1408 may be releasably and removably mounted with respect to the body portions 1402*a* and 1402*b* (e.g., by sliding the spring member 1408 outward). This feature may allow interchange of one spring member 1408 for another, e.g., to provide different impact-attenuation characteristics for different uses, users, and/or locations in a footwear structure, to replace a broken or damaged spring member 1408; etc. Alternatively or additionally, if desired, the body portions 1402*a* and 1402*b* (optionally with the spring member attached thereto) may be releasably and removably mounted with respect to any present base member (e.g., base member 1420) or other device or structure to which it is attached (such as an article of footwear or other foot-receiving device, etc,). As still another option or alternative, if desired, the overall structure 102*a*/102*b* may be releasably and removably mounted with respect to another article to which it is mounted (with or without a base member 1420), such as an article of footwear or other foot-receiving device, etc. A wide variety of options are possible to allow replacement, interchange, and/or customization of the impact-attenuation properties, e.g., of an article of footwear or other foot-receiving device by replacing, exchanging, and/or reorienting the spring member 1408, body portions 1402*a* and 1402*b*, and/or overall impact-attenuation member 102*a*/102*b*, e.g., to further make one member 102*b* less resistant to impact forces that one or more of the other members 102*a* in the footwear structure.

Again, the overall impact-attenuation member structure 102*a*/102*b* according to this example provides excellent impact-attenuation properties against substantially vertical, jump, or step landing forces 1422 while also providing stability with respect to lateral or shear forces 1424. This may be accomplished, using the structure 102*a*/102*b*, by mounting the structure 102*a* such that the axial length of the spring member 1408 extends substantially in the expected direction of the lateral forces 1424 (e.g., extending in the medial-to-lateral side direction of the article of footwear or other foot-receiving device product), which in turn mounts the body portions 1402*a* and 1402*b* and/or base member 1420 such that their major surfaces extend substantially parallel to the expected direction of the lateral forces 1424. The structures 102*b* may be rotated somewhat or otherwise modified in orientation as compared to structures 102*a*, as described above.

Figure 15A:
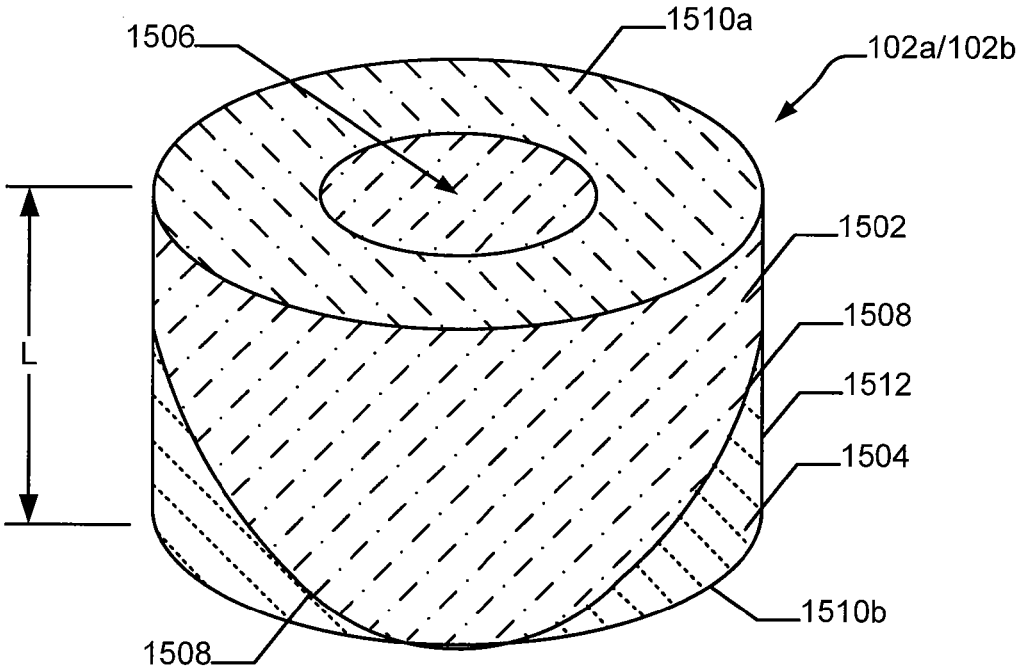

FIGS. 15A through 15C illustrate another example impact-attenuating element 102*a*/102*b* that may be used in accordance with various examples of this invention. This example impact-attenuating element 102*a*/102*b* includes a first impact-attenuating material 1502 in a first discrete region of the structure 102*a*/102*b* and a second impact-attenuating material 1504 in a second discrete region of the structure 102*a*/102*b*. These first and second regions of the impact-attenuating element 102*a*/102*b* may combine together to form at least a portion of an overall integral or unitary structure. For example, if desired, the two impact-attenuating materials 1502 and 1504 may be fixed to one another, e.g., via an adhesive, heat processing, and/or in any other desired or suitable manner. As another example, the two impact-attenuating materials 1502 and 1504 may be maintained as separable elements and held together by external forces in use (e.g., the user's weight, mechanical connectors, structural elements in the foot-covering member and/or the foot-supporting member, etc.), without departing from the invention. While the overall composite structure 102*a*/102*b* may take on various sizes and shapes without departing from the invention, in this illustrated example the impact-attenuating element 102*a*/102*b* generally is a cylindrically-shaped composite member formed from impact-attenuating materials 1502 and 1504 with an overall round cross sectional shape. In at least some example structures 102*a*/102*b*, if desired, an open space 1506 may be defined in the structure, e.g., at a central portion of the cylindrically-shaped composite member 102*a*/102*b*. This open space 1506, when present, may extend all of the way through member 102*a*/102*b* or partially through it.

The second impact-attenuating material 1504 may differ in various respects compared to the first impact-attenuating material 1502 such that at least one impact-attenuating characteristic of the second impact-attenuating material 1504 differs from the corresponding characteristic(s) of the first impact-attenuating material 1502. For example, in the illustrated example structure 102*a*/102*b*, the impact-attenuating materials 1502 and 1504 may be formed from foam or other impact-attenuating material, and the material making up the first impact-attenuating material 1502 may have a lower density than the material making up the second impact-attenuating material 1504 such that the second impact-attenuating material 1504 provides greater support, better stability, and/or a different, more firm impact-attenuating effect as compared to the first impact-attenuating material 1502.

In at least some example structures according to the invention, the first impact-attenuating material 1502 may face the second impact-attenuating material 1504 along an interface 1508, and in at least some example structures, the two impact-attenuating materials 1502 and 1504 may contact one another along this interface 1508. This interface 1508, as illustrated in FIG. 15A, may extend along a diagonal of the cylindrically-shaped composite member 102*a*/102*b*. In the illustrated example structure 102*a*/102*b*, the area of each transverse cross section parallel with end faces 1510*a* and 1510*b* of the impact-attenuating element 102*a*/102*b* will contain a different percentage area of the first impact-attenuating material 1502 and the second impact-attenuating material 1504. In other words, in this illustrated example, the cross sectional area of each impact-attenuating material 1502 and 1504 changes continuously along the axial length L of the impact-attenuating element 102*a*/102*b*.

By providing impact-attenuating materials 1502 and 1504 of different densities and arranging these materials along a sloping interface 1508 such that the cross sectional area of each impact-attenuating material 1502 and 1504 changes continuously along the axial length L of the impact-attenuating element 102*a*/102*b*, at least one impact-attenuating characteristic of the impact-attenuating element 102*a*/102*b* may be controlled by changing a position or orientation of at least a portion of the impact-attenuating element 102*a*/102*b* in the device in which it is placed. Of course, other ways of changing and/or controlling the impact-attenuating characteristics of an element 102*a*/102*b* are possible without departing from the invention. Various example features of the invention will be described in more detail below.

As mentioned above, the example impact-attenuating element 102*a*/102*b* illustrated in FIG. 15A has a generally round cross-section with a round central opening 1506. Of course, many variations in the size, relative size, shape, and orientation of the various features of an impact-attenuating element 102*a*/102*b*, including its exterior shape and the shapes of any open areas, are possible without departing from the invention. For example, both the outer surface 1512 and the interior open area 1506 of the element 102*a*/102*b* may have any desired sizes, relative sizes, and/or shapes without departing from the invention, such as round, square, triangular, other polygons, elliptical, etc. The shapes of the open area 1506 and exterior surface 1512 also may differ from one another in a given structure without departing from the invention. Also, the impact-attenuating element 102*a*/102*b* need not have a right cylindrical shape in all examples of the invention. Other shapes, such as non-right cylindrical, spherical, hemispherical, hemi-elliptical, elliptical, cubic, conical, truncated conical, etc., may be used for the impact-attenuating element overall shape without departing from the invention. Additionally, if desired, in at least some examples, no open area 1506 need be provided such that the element 102*a*/102*b* is a solid or non-hollow material. As still another alternative, if desired, one or both ends of the open area 1506 may be closed off so as to define a closed structure (or partially closed structure) with one or more hollowed out interior portions without departing from the invention. As still additional examples, the open area 1506, if present, need not extend all the way through the cylindrically-shaped member 102*a*/102*b*, and it need not be centrally located.

The impact-attenuating element 102*a*/102*b* need not include an impact-attenuating material interface 1508 that is a smooth, constantly sloped line or curve in all examples of the invention. Rather, if desired, the interface 1508 may be curved or shaped such that some portions of the interface surface are more sloped than other portions. Also, as another example, the interface 1508 may be stepped, with constant or differing sized steps, flat or slanted steps, etc., without departing from the invention. In still other examples, if desired, the interface slope or steps on one side of open area 1506 may differ (e.g., in size slope, number, or orientation, etc.) from the interface slope or steps on the other side of open area 1506. Many other variations in the interface 1508 slope, orientation, size, shape, and/or arrangement may occur without departing from the invention. As still additional examples, no clear-cut interface 1508 is required in all examples of the invention. Rather, if desired, the density or other impact-attenuating characteristic of the material may change gradually across the volume of the impact-attenuating element 102*a*/102*b*. In other words, the regions of different impact-attenuating material need not have a clear interface between them in all examples of the invention (e.g., a more gradual change in the materials, densities, or regions is possible in at least some examples of the invention).

Also, impact-attenuating elements in accordance with at least some examples of the invention are not limited to those having two regions with different impact-attenuating material densities. Any number of impact-attenuating materials, densities, and/or interfaces may be provided in an impact-attenuating element 102*a*/102*b* without departing from the invention. Moreover, it is not necessary for the two impact-attenuating materials to differ compositionally. Rather, if desired, in at least some examples of the invention, an impact-attenuating element 102*a*/102*b* may be constructed from a single piece or type of impact-attenuating material wherein one area or region of a unitary piece of impact-attenuating material is treated in some manner so as to change at least one impact-attenuating characteristic of the material in that region as compared to the corresponding impact-attenuating characteristic(s) of the material in another region. Such treatments may include heat treatment, chemical treatments, addition of foam material modifiers during production of at least one region, laser processing, other processing, etc. Even when two (or more) discrete regions of impact-attenuating materials are provided, the general composition of the materials may be the same in each region without departing from the invention, e.g., each region may comprise a polyurethane foam material, but the foam materials may have different densities.

FIGS. 15B and 15C illustrate an overhead view of an impact-attenuating element 102*a*/102*b* of the general types described above at various positions and orientations in a heel portion of a foot-receiving device 1520. In this example arrangement, at least a bottom portion of the impact-attenuating element 102*a*/102*b* fits into an opening or receptacle 1522 defined in a midsole (or other portion) of the foot-receiving device structure 1520. In use, if desired, the top portion of the impact-attenuating element 102*a*/102*b* may be covered so that it does not directly contact the user's foot, e.g., by a closure element, an insole element or other portion of the foot-receiving device's 1520 upper member or sole member structure (no covering is shown in FIGS. 15B and 15C). Alternatively, if desired, a user's foot may directly contact the impact-attenuating element 102*a*/102*b* in the foot-receiving device structure 1520.

FIGS. 15B and 15C illustrate the impact-attenuating member 102*a*/102*b* at different locations in a footwear structure. More specifically, FIG. 15B illustrates the impact-attenuating member 102*b* in the rear, lateral heel portion of the footwear structure (e.g., at the landing position). FIG. 15C, on the other hand, illustrates impact-attenuating member 102*a* in the rear, medial heel location (or other locations, such as the posting location) of the footwear structure (e.g., at the landing position). Note the differences in the orientations of the members 102*a*/102*b* in FIGS. 15B and 15C. In the orientation shown in FIG. 15B, the impact-attenuating member 102*b* provides less resistance to impact forces upon landing a step or jump. On the other hand, in the arrangement shown in FIG. 15C, the impact-attenuating member provides greater resistance to impact forces upon landing a step or jump. If desired, the impact-attenuating members 102*a*/102*b* may be arranged such that users, or others, can selectively reorient them (e.g., using handle member 1540). Of course, the various impact-attenuating member orientations of FIGS. 15B and 15C also may be used at other locations in the foot-supporting member structure.

Various ways of maintaining the impact-attenuating elements 102*a*/102*b* in place with respect to the foot-receiving device structure 1520 may be used without departing from the invention. For example, the midsole, outsole, upper member, or other portion of the foot-receiving device structure 1520 may include a receptacle (e.g., a cup-shaped receptacle element 1522 that defines opening) or the like into which the top and/or bottom portion(s) of the impact-attenuating element 102*a*/102*b* is (are) designed to fit. If desired, the side walls defining the opening may be formed from foam or other impact-attenuating material (e.g., like that used in element 102*a*/102*b* and/or other portions of the midsole structure). The top and/or bottom surface(s) of the receptacle may include raised ribs designed to fit into corresponding slots or grooves defined in the top and/or bottom of the impact-attenuating element 102*a*/102*b* or vice versa. Additionally or alternatively, as another example, one or more side surfaces of the receptacle 1522 may include raised ribs designed to fit into corresponding slots or grooves defined in the side walls of the impact-attenuating element 102*a*/102*b* or vice versa. As still another example, the top and/or bottom surfaces of the receptacle and the impact-attenuating element 102*a*/102*b* each may include raised ribs and slot or groove portions without departing from the invention. As still another example, the top, bottom, and/or side surfaces of the receptacle and/or the impact-attenuating element may be roughed and/or otherwise formed from suitable materials and/or formed with suitable surfaces or surface treatments so as to create a high coefficient of friction between these elements, to thereby hinder and/or prevent easy rotation of the impact-attenuating element 100 with respect to the receptacle by a simple friction fit.

As still another example, if desired, the impact-attenuating element 102*a*/102*b* may be releasably held in place with respect to the foot-receiving device structure 1520 by some type of mechanical connector or fixing element, such as a stop member that extends from the wall of a receptacle into a side of the impact-attenuating element. As additional examples, one or more set screws, brake members, adhesives, lock or bolt type elements, or the like, also may be used to hold the impact-attenuating element 102*a*/102*b* in place with respect to the foot-receiving device structure 1520. The impact-attenuating element 102*a*/102*b* also may be formed as a plug or a part that slides and/or otherwise is received onto a shelf and/or into a drawer type system provided as part of the foot-receiving device structure 1520.

As still additional examples, the physical shape of the impact-attenuating element and/or the receptacle into which it fits, if any (e.g., part of the foot-receiving device structure), may at least partially help maintain the impact-attenuating element in place with respect to the remainder of the foot-receiving device structure. FIGS. 16A and 16B illustrate one example structure. As shown in FIG. 16A, an impact-attenuating element 102*a*/102*b* according to this example of the invention includes a multi-sided polygon structure formed as a cylinder. Like the structure shown in FIGS. 15A through 15C, the cylindrical element 102*a*/102*b* may be formed from two (or more) impact-attenuating materials 1602 and 1604 (e.g., foam materials), wherein one material has at least one impact-attenuating characteristic different from the other material (e.g., material 1602 may be made from a foam material (or other material) having a lower density than material 1604). If desired, the cylindrical structure may be divided on a diagonal (as in FIG. 15A) such that the two impact-attenuating materials 1602 and 1604 face and/or contact one another along an interface extending along the diagonal of the cylinder 102*a*/102*b*. Of course, other ways of providing the regions with different impact-attenuating characteristics may be used without departing from the invention, e.g., as described above.

Like FIGS. 15B and 15C, FIGS. 16A and 16B illustrate different potential orientations of the impact-attenuating member 102*a*/102*b*, e.g., for the rear, lateral heel region (or other regions, such as the step landing area) (FIG. 16A) and the rear, medial heel region (or other regions, such as the posting area) (FIG. 16B) of a footwear structure.

In use, a user may change the impact-attenuating characteristics of the impact-attenuating element 102*a*/102*b* (and thus the characteristics of the entire foot-receiving device structure including this impact-attenuating element 102*a*/102*b*) by lifting or otherwise removing the impact-attenuating element 102*a*/102*b* out of the opening 1606 provided in the midsole, outsole, or other portion of the foot-receiving device structure via handle 1608 (e.g., opening 1606 may be defined by a corresponding receptacle in the midsole, outsole, upper member, etc.). The impact-attenuating element 102*a*/102*b* then may be turned, flipped over, replaced by another, have an impact-attenuating structure added to or taken away from it, or the like, and it then may be replaced within the opening 1606 (or otherwise re-engaged with the foot-receiving device structure). Such changes in orientation also may be used to change the force resistance properties of one impact-attenuating member (e.g., 102*a*) with respect to another (e.g., 102*b*) at another location. As evident from comparing FIGS. 16A and 16B, the impact-attenuating element 102*a* is oriented approximately 60 degrees different from impact-attenuating element 102*b*. The corners 1610*a* of each face 1610 of the impact-attenuating element 102*a*/102*b* engage corresponding corners of the receptacle defining the opening 1606, thereby at least partially holding the impact-attenuating element 102*a*/102*b* in place with respect to the foot-receiving device structure. Of course, an impact-attenuating element and/or its corresponding receptacle in a foot-receiving device structure may have any desired number of faces 1610 without departing from the invention. Moreover, any size or shape faces 1610 may be provided without departing from the invention. Additionally, if desired, some face(s) may be sized and shaped differently from other face(s) without departing from the invention.

Figure 17B:
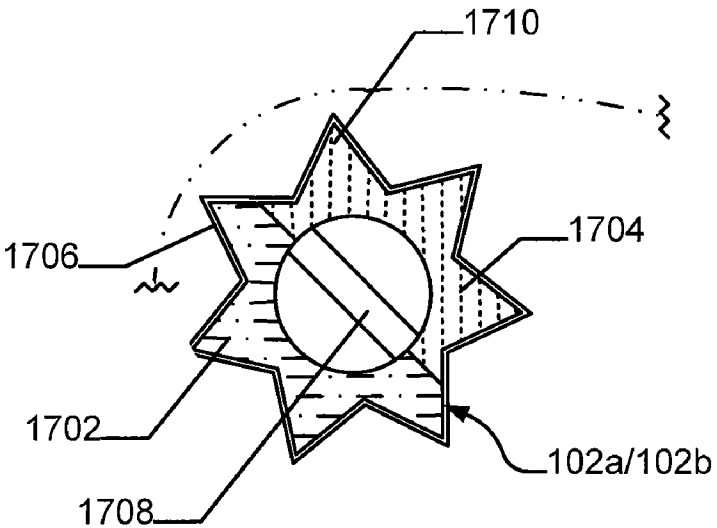
Figure 17A:
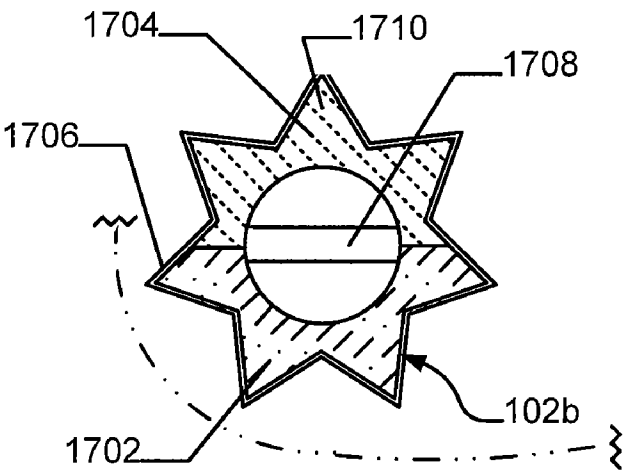

FIGS. 17A and 17B illustrate still another example of an impact-attenuating element structure 102*a*/102*b* according to some examples of this invention. In this example, the impact-attenuating element 102*a*/102*b* is a star-shaped cylinder that fits into a corresponding opening 1706 defined by a receptacle provided as part of a foot-receiving device structure (e.g., in the heel portion of a midsole, outsole, insole, or upper member of a piece of footwear). Like the structures shown in FIGS. 15A-15C, 16A, and 16B, the cylindrical element 102*a*/102*b* may be formed from two (or more) impact-attenuating materials 1702 and 1704 (e.g., foam materials), wherein one material has at least one impact-attenuating characteristic different from the other material (e.g., material 1702 may be made from a foam material (or other material) having a lower density than material 1704). If desired, the cylindrical structure may be divided on a diagonal (as in FIG. 15A) such that the two impact-attenuating materials 1702 and 1704 face and/or contact one another along an interface extending along the diagonal of the cylinder 102*a*/102*b*. Of course, other ways of providing the regions with different impact-attenuating characteristics may be used without departing from the invention, e.g., as described above.

Like FIGS. 15B and 15C, FIGS. 17A and 17B illustrate different potential orientations of the impact-attenuating member 102*a*/102*b*, e.g., for the rear, lateral heel region (or other regions, such as the step landing region) (FIG. 17A) and the rear, medial heel region (or other regions, such as the posting region) (FIG. 17B) of a footwear structure.

In use, a user may change the impact-attenuating characteristics of the impact-attenuating element 102*a*/102*b* (and thus the characteristics of the entire foot-receiving device structure including this impact-attenuating element 102*a*/102*b*) by lifting or otherwise removing the impact-attenuating element 102*a*/102*b* out of the opening 1706 provided in the midsole, outsole, insole, upper member or other portion of the foot-receiving device structure via handle 1708 (e.g., opening 1706 may be defined by a corresponding receptacle in the midsole, outsole, upper member, etc.). The impact-attenuating element 102*a*/102*b* then may be turned, flipped over, replaced by another, have an impact-attenuating structure added to or taken away from it, or the like, and it then may be replaced within the opening 1706 (or otherwise engaged with the foot-receiving device structure). Such changes in orientation also may be used to change the force resistance properties of one impact-attenuating member (e.g., 102*a*) with respect to another (e.g., 102*b*) at another location. As evident from comparing FIGS. 17A and 17B, the impact-attenuating element 102*a* is oriented approximately 50 degrees different from impact-attenuating element 102*b*. The arms 1710 of the impact-attenuating element 102*a*/102*b* engage corresponding arm receptacles defining opening 1706, thereby at least partially holding the impact-attenuating element 102*a*/102*b* in place with respect to the foot-receiving device structure. Of course, an impact-attenuating element and/or its corresponding receptacle in a foot-receiving device structure may have any desired number of arms 1710 without departing from the invention. Moreover, any size or shape arms 1710 may be provided without departing from the invention. Additionally, if desired, some arm(s) 1710 (and their corresponding arm receptacle(s)) may be sized and shaped differently from other arm(s) in the structure 102*a*/102*b* without departing from the invention.

If desired, footwear structures may be provided such that the various impact-attenuating members 102*a*/102*b* have fixed positions, albeit with members 102*b* oriented in some manner different from one or more of members 102*a* (e.g., rotationally different, as shown in FIGS. 2A through 2C, with other orientation differences, etc.) Any differences in orientations may be used without departing from the invention, such as laterally offset, medially offset, etc.

Rather than having the various impact-attenuating members 102*a*/102*b* at permanently fixed locations and orientations in a footwear structure, one or more of the members 102*a*/102*b* may be movably mounted, e.g., to allow user controllable changes in the impact-attenuation properties. Any way of providing this movability may be provided without departing from this invention, such as through the use of the various mounting elements 414, 614, 712, etc. described above, through the use of retaining structures (e.g., 1330, 1332, etc.), through the use of the structures of FIGS. 15A through 17B, etc. As yet additional examples, if desired, some portions of impact-attenuating members 102*a*/102*b* may be mounted on a rotatable portion of base members 108 and/or 110, to allow changes in rotational position. As still additional examples, if desired, orientation changes may be made by sliding, pivoting, or otherwise moving one or more of the impact-attenuating members 102*a*/102*b* with respect to one another, e.g., along or in a groove or slot provided in base members 108 and/or 110 or other portions of the footwear structure. Other movable and/or securable orientations and arrangements also are possible without departing from this invention.

E. CONCLUSION

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. An article of footwear, comprising:

an upper member; and a sole structure engaged with the upper member, wherein the sole structure includes:

a first impact-attenuating member located in a heel portion of the sole structure, wherein the first impact-attenuating member is arranged in a first angular orientation with respect to a longitudinal direction extending from the heel portion to a toe portion of the sole structure, a second impact-attenuating member separate from the first impact-attenuating member and having a size and shape that are substantially similar to a size and shape of the first impact-attenuating member, wherein the second impact-attenuating member is located at a rear, lateral heel portion of the sole structure, wherein the second impact-attenuating member is arranged at a second angular orientation with respect to the longitudinal direction extending from the heel portion to the toe portion of the sole structure, and wherein the second angular orientation differs from the first angular orientation, wherein impact attenuating properties of the second impact-attenuating member are based on the second angular orientation, and a third impact-attenuating member located in the heel portion on a lateral side or a medial side of the article of footwear and separate from the first and second impact-attenuating members, wherein the third impact-attenuating member is located closer to a front of the article of footwear as compared to the second impact-attenuating member, wherein the first, second, and third impact-attenuating members extend between a first base member and a second base member.

2. An article of footwear according to claim 1, wherein the second impact-attenuating member provides less resistance to an impact force as compared with the first impact-attenuating member.

3. An article of footwear according to claim 1, wherein the first impact-attenuating member is located at a rear, medial heel portion of the sole structure.

4. An article of footwear according to claim 1, wherein the first impact-attenuating member is located closer to a front of the article of footwear as compared to the second impact-attenuating member.

5. An article of footwear according to claim 4, wherein the first impact-attenuating member is located on the lateral side of the article of footwear.

6. An article of footwear according to claim 4, wherein the first impact-attenuating member is located on the medial side of the article of footwear.

7. An article of footwear according to claim 6, wherein the third impact-attenuating member is located at the lateral side of the article of footwear.

8. An article of footwear according to claim 1, wherein the second impact-attenuating member provides less resistance to an impact force as compared with the third impact-attenuating member.

9. An article of footwear according to claim 1, wherein the third impact-attenuating member is arranged in substantially the first angular orientation.

10. An article of footwear according to claim 1, wherein the first impact-attenuating member is located at a rear, medial heel portion of the sole structure, and wherein the third impact-attenuating member is located at the lateral side of the article of footwear.

11. An article of footwear according to claim 10, wherein the second impact-attenuating member provides less resistance to an impact force as compared with the third impact-attenuating member.

12. An article of footwear according to claim 10, wherein the third impact-attenuating member is arranged in substantially the first angular orientation.

13. An article of footwear according to claim 1, wherein the first impact-attenuating member is located at a rear, medial heel portion of the sole structure, and wherein the third impact-attenuating member is located at the medial side of the article of footwear.

14. An article of footwear according to claim 13, wherein the second impact-attenuating member provides less resistance to an impact force as compared with the third impact-attenuating member.

15. An article of footwear according to claim 10, wherein the third impact-attenuating member is arranged in substantially the first angular orientation.

16. An article of footwear according to claim 1, wherein the first impact-attenuating member is located at a rear, medial heel portion of the sole structure, and wherein the third impact-attenuating member located at the lateral side of the article of footwear, and wherein the sole structure further includes:

a fourth impact-attenuating member located in the heel portion on the medial side of the article of footwear and separate from the first, second, and third impact-attenuating members, wherein the fourth impact-attenuating member is located closer to the front of the article of footwear as compared to the second impact-attenuating member, and wherein the fourth impact-attenuating member extends between the first base member and the second base member.

17. An article of footwear according to claim 16, wherein the second impact-attenuating member provides less resistance to an impact force as compared with the third and fourth impact-attenuating members.

18. An article of footwear according to claim 16, wherein the third impact-attenuating member is arranged in substantially the first angular orientation, and wherein the fourth impact-attenuating member is arranged in substantially the first angular orientation.

19. An article of footwear according to claim 1, wherein the first impact-attenuating member has the same structure as the second impact-attenuating member.

20. An article of footwear according to claim 1, wherein the first impact-attenuating member has an axial direction, and wherein in the first angular orientation, the axial direction is substantially perpendicular to the longitudinal direction.

21. An article of footwear according to claim 20, wherein the second impact-attenuating member has an axial direction, and wherein in the second angular orientation, the axial direction of the second impact-attenuating member extends at an angle of 15° to 75° with respect to the longitudinal direction.

22. An article of footwear according to claim 21, wherein the second impact-attenuating member is movably mounted so as to allow change in the angle.

23. An article of footwear according to claim 22, wherein the second impact-attenuating member is rotatable about an axis substantially perpendicular to the longitudinal direction and substantially perpendicular to the axial direction.

24. An article of footwear according to claim 20, wherein the second impact-attenuating member has an axial direction, and wherein in the second angular orientation, the axial direction of the second impact-attenuating member extends at an angle of 25° to 65° with respect to the longitudinal direction.

25. An article of footwear according to claim 20, wherein the second impact-attenuating member has an axial direction, and wherein in the second angular orientation, the axial direction of the second impact-attenuating member extends at an angle of 30° to 60° with respect to the longitudinal direction.

26. An article of footwear according to claim 1, wherein the second impact-attenuating member has an axial direction, and wherein in the second angular orientation, the axial direction extends at an angle of 15° to 75° with respect to the longitudinal direction.

27. An article of footwear according to claim 26, wherein the second impact-attenuating member is movably mounted so as to allow change in the angle.

28. An article of footwear according to claim 27, wherein the second impact-attenuating member is rotatable about an axis substantially perpendicular to the longitudinal direction and substantially perpendicular to the axial direction.

29. An article of footwear according to claim 1, wherein the second impact-attenuating member has an axial direction, and wherein in the second angular orientation, the axial direction extends at an angle of 25° to 65° with respect to the longitudinal direction.

30. An article of footwear according to claim 1, wherein the second impact-attenuating member has an axial direction, and wherein in the second angular orientation, the axial direction extends at an angle of 30° to 60° with respect to the longitudinal direction.

31. An article of footwear according to claim 1, wherein the first impact-attenuating member has the same structure as the second impact-attenuating member, and wherein, at least in part due to differences in the first angular orientation as compared with the second angular orientation, the second impact-attenuating member provides less resistance to an impact force as compared with the first impact-attenuating member.

32. An article of footwear according to claim 1, wherein, at least in part due to differences in the first angular orientation as compared with the second angular orientation, the second impact-attenuating member provides less resistance to an impact force as compared with the first impact-attenuating member.

33. An article of footwear according to claim 1, wherein the first impact-attenuating member and the second impact-attenuating member each remains at least partially exposed from an exterior of the article of footwear.

34. An article of footwear according to claim 1, wherein the first impact-attenuating member and the second impact-attenuating member are engaged with a common base member.

35. The article of footwear of claim 1, wherein the impact-attenuating properties of the second impact-attenuating member are adjustable based on adjustment of the second angular orientation.

36. The article of footwear of claim 1, wherein adjustment of an angular orientation of the first impact-attenuating member or the second impact-attenuating member adjusts the impact attenuation properties of the impact-attenuating member.

37. The article of footwear of claim 1, wherein impact attenuating properties of the first impact-attenuating member are based on the first angular orientation.

38. A foot-receiving device, comprising:

a foot-covering member; and a foot-supporting member engaged with the foot-covering member, wherein the foot-supporting member includes:

a first impact-attenuating member located in a heel portion of the foot-supporting member, wherein the first impact-attenuating member is arranged in a first angular orientation with respect to a longitudinal direction extending from the heel portion to a toe portion of the foot-supporting member, a second impact-attenuating member separate from the first impact-attenuating member and having a size and shape that are substantially similar to a size and shape of the first impact-attenuating member, wherein the second impact-attenuating member is located at a rear, lateral heel portion of the foot-supporting member, wherein the second impact-attenuating member is arranged at a second angular orientation with respect to the longitudinal direction extending from the heel portion to the toe portion of the foot-supporting member, and wherein the second angular orientation differs from the first angular orientation, wherein impact attenuating properties of the second impact-attenuating member are based on the second angular orientation, and a third impact-attenuating member located in the heel portion on a lateral side or a medial side of the foot-receiving device and separate from the first and second impact-attenuating members, wherein the third impact-attenuating member is located closer to a front of the foot-receiving device as compared to the second impact-attenuating member, wherein the first impact-attenuating member, the second impact-attenuating member, and the third impact-attenuating member extend between a first base member and a second base member.

39. A foot-receiving device according to claim 38, wherein the second impact-attenuating member provides less resistance to an impact force as compared with the first impact-attenuating member.

40. A foot-receiving device according to claim 38, wherein the first impact-attenuating member is located at a rear, medial heel portion of the foot-supporting member.

41. A foot-receiving device according to claim 38, wherein the first impact-attenuating member is located closer to a front of the foot-receiving device as compared to the second impact-attenuating member.

42. A foot-receiving device according to claim 41, wherein the first impact-attenuating member is located on the lateral side of the foot-receiving device.

43. A foot-receiving device according to claim 41, wherein the first impact-attenuating member is located on the medial side of the foot-receiving device.

44. A foot-receiving device according to claim 43, wherein the third impact-attenuating member is located at the lateral side of the foot-receiving device.

45. A foot-receiving device according to claim 38, wherein the first impact-attenuating member is located at a rear, medial heel portion of the foot-supporting member, and wherein the third impact-attenuating member is located at the lateral side of the foot-receiving device.

46. A foot-receiving device according to claim 38, wherein the first impact-attenuating member is located at a rear, medial heel portion of the foot-supporting member, and wherein the third impact-attenuating member is located at the medial side of the foot-receiving device.

47. A foot-receiving device according to claim 38, wherein the first impact-attenuating member is located at a rear, medial heel portion of the foot-supporting member, wherein the third impact-attenuating member is located at the lateral side of the foot-receiving device and wherein the foot-supporting member further includes:

a fourth impact-attenuating member located in the heel portion on the medial side of the foot-receiving device and separate from the first, second, and third impact-attenuating members, wherein the fourth impact-attenuating member is located closer to the front of the foot-receiving device as compared to the second impact-attenuating member, and wherein the fourth impact-attenuating member extends between the first base member and the second base member.

48. A foot-receiving device according to claim 38, wherein the first impact-attenuating member has the same structure as the second impact-attenuating member.

49. A foot-receiving device according to claim 38, wherein the first impact-attenuating member has an axial direction, and wherein in the first angular orientation, the axial direction is substantially perpendicular to the longitudinal direction.

50. A foot-receiving device according to claim 38, wherein the second impact-attenuating member has an axial direction, and wherein in the second angular orientation, the axial direction extends at an angle of 15° to 75° with respect to the longitudinal direction.

51. A foot-receiving device according to claim 50, wherein the second impact-attenuating member is movably mounted so as to allow change in the angle.

52. A foot-receiving device according to claim 38, wherein the second impact-attenuating member has an axial direction, and wherein in the second angular orientation, the axial direction extends at an angle of 25° to 65° with respect to the longitudinal direction.

53. A foot-receiving device according to claim 38, wherein the second impact-attenuating member has an axial direction, and wherein in the second angular orientation, the axial direction extends at an angle of 30° to 60° with respect to the longitudinal direction.

54. A foot-receiving device according to claim 38, wherein, at least in part due to differences in the first angular orientation as compared with the second angular orientation, the second impact-attenuating member provides less resistance to an impact force as compared with the first impact-attenuating member.

55. A foot-receiving device according to claim 38, wherein the first impact-attenuating member and the second impact-attenuating member are engaged with a common base member.

56. The foot-receiving device of claim 38, wherein the impact-attenuating properties of the second impact-attenuating member are adjustable based on adjustment of the second angular orientation.

57. The foot-receiving device of claim 38, wherein adjustment of an angular orientation of the first impact-attenuating member or the second impact-attenuating member adjusts the impact attenuation properties of the impact-attenuating member.

58. The foot-receiving device of claim 38, wherein impact attenuating properties of the first impact-attenuating member are based on the first angular orientation.

* * * * *